US007677251B2

(12) United States Patent
Barnes et al.

(10) Patent No.: US 7,677,251 B2
(45) Date of Patent: Mar. 16, 2010

(54) APPARATUS AND METHODS FOR MANUFACTURING CIGARETTES

(75) Inventors: Vernon Brent Barnes, Advance, NC (US); August Joseph Borschke, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 529 days.

(21) Appl. No.: 11/483,311

(22) Filed: Jul. 7, 2006

(65) Prior Publication Data

US 2008/0006284 A1 Jan. 10, 2008

(51) Int. Cl.
*A24C 5/12* (2006.01)
*A24C 5/31* (2006.01)
*A24C 5/14* (2006.01)

(52) U.S. Cl. ..... 131/65; 131/58; 131/60

(58) Field of Classification Search ..... 131/58–76
See application file for complete search history.

(56) References Cited

U.S. PATENT DOCUMENTS

| | | | |
|---|---|---|---|
| RE7,871 | E | 9/1877 | Nichols |
| 636,625 | A | 11/1899 | Brehm |
| 638,887 | A | 12/1899 | Root |
| 646,938 | A | 4/1900 | Andstem |
| 760,800 | A | 5/1904 | Nice |
| 828,611 | A | 8/1906 | Kobler |
| 969,376 | A | 9/1910 | Kiely |
| 1,064,568 | A | 6/1913 | Toplis |
| 1,075,050 | A | 10/1913 | Mihills |
| 1,196,387 | A | 8/1916 | Noon |
| 1,267,201 | A | 5/1918 | Fleming |
| 1,735,520 | A | 11/1929 | Williams |
| 2,296,772 | A | 9/1942 | Crist |
| 2,376,103 | A | 5/1945 | Wahl |

(Continued)

FOREIGN PATENT DOCUMENTS

| | | |
|---|---|---|
| CA | 889660 | 1/1972 |

(Continued)

OTHER PUBLICATIONS

U.S. Appl. No. 11/143,889, filed Jun. 1, 2005, Thomas et al.

(Continued)

*Primary Examiner*—Steven P Griffin
*Assistant Examiner*—Jodi Cohen
(74) *Attorney, Agent, or Firm*—Kilpatrick Stockton LLP

(57) ABSTRACT

An apparatus and method for manufacturing small quantities of cigarettes provides for such manufacture in a substantially simultaneous fashion while maintaining consistent quality between the cigarettes. The apparatus and method provide for delivering at least one charge of tobacco filler from a supply of tobacco filler onto a predetermined length of wrapping paper in a garniture. The wrapping paper can be formed about the charge of tobacco filler by a forming mechanism in the garniture to form a cigarette rod having a finite length. The formed cigarette rod can then be transferred to a cutting device where, in a separate step, the cigarette rod can be cut into a plurality of individual cigarettes. The cigarettes may have filter elements attached, and may be packaged for a consumer. The filter element and tipping paper can provide for air dilution of the cigarettes.

5 Claims, 8 Drawing Sheets

U.S. PATENT DOCUMENTS

| | | | | |
|---|---|---|---|---|
| 2,425,888 | A | | 8/1947 | Matteson et al. |
| 2,427,884 | A | | 9/1947 | Snodgrass |
| 2,427,957 | A | | 9/1947 | Getts, Jr. |
| 2,496,375 | A | | 2/1950 | Carter |
| 2,503,353 | A | | 4/1950 | Pugh |
| 2,551,095 | A | | 5/1951 | Chaze |
| 2,594,747 | A | | 4/1952 | Du Laney |
| 2,633,133 | A | | 3/1953 | Higgins |
| 2,699,788 | A | | 1/1955 | Kastner |
| 2,714,383 | A | | 8/1955 | Gee |
| 2,731,971 | A | | 1/1956 | Kastner |
| 2,850,019 | A | | 9/1958 | Sosa |
| 2,868,209 | A | | 1/1959 | Marcotte |
| 3,006,348 | A | | 10/1961 | Banning, Jr. |
| 3,011,498 | A | | 12/1961 | Armelin |
| 3,124,141 | A | | 3/1964 | Seitter |
| 3,127,900 | A | | 4/1964 | Kastner |
| 3,202,156 | A | | 8/1965 | Kappeler et al. |
| 3,491,768 | A | | 1/1970 | Paynter |
| 3,645,272 | A | | 2/1972 | Jenkins et al. |
| 3,688,777 | A | | 9/1972 | Kastner |
| 3,693,313 | A | | 9/1972 | Sexstone |
| 3,693,630 | A | | 9/1972 | Kastner |
| 3,732,873 | A | | 5/1973 | O'Rear |
| 3,821,915 | A | | 7/1974 | Larrable |
| 3,822,710 | A | | 7/1974 | Bramhill |
| 3,884,013 | A | | 5/1975 | Solomon |
| 3,892,245 | A | | 7/1975 | Asbill, Jr. |
| 4,164,229 | A | | 8/1979 | Hurt |
| 4,167,948 | A | | 9/1979 | Moscovitch |
| 4,474,190 | A | | 10/1984 | Brand |
| 4,534,367 | A | | 8/1985 | Newsome |
| 4,554,931 | A | | 11/1985 | Born |
| 4,572,216 | A | | 2/1986 | Josuttis et al. |
| 4,760,853 | A | | 8/1988 | Gamberini |
| 4,763,673 | A | | 8/1988 | Barnes et al. |
| 4,771,793 | A | | 9/1988 | Kastner |
| 4,832,056 | A | | 5/1989 | Bryant et al. |
| 4,884,602 | A | | 12/1989 | Yamamoto et al. |
| 4,887,617 | A | | 12/1989 | Ruppert et al. |
| 4,962,773 | A | | 10/1990 | White et al. |
| 5,018,536 | A | | 5/1991 | Liebich |
| 5,072,740 | A | | 12/1991 | Gätschmann et al. |
| 5,088,506 | A | | 2/1992 | Kastner |
| 5,105,830 | A | | 4/1992 | Brackmann et al. |
| 5,133,366 | A | | 7/1992 | Liebich |
| 5,135,008 | A | * | 8/1992 | Oesterling et al. ..... 131/94 |
| 5,139,140 | A | | 8/1992 | Burrows et al. |
| 5,141,000 | A | | 8/1992 | Ruppert et al. |
| 5,167,241 | A | | 12/1992 | Ruppert et al. |
| 5,167,248 | A | | 12/1992 | Tuller |
| 5,197,495 | A | | 3/1993 | Ruppert et al. |
| 5,425,215 | A | | 6/1995 | Lewis et al. |
| 5,465,554 | A | | 11/1995 | Lewis et al. |
| 5,524,515 | A | | 6/1996 | Boda |
| 5,615,692 | A | * | 4/1997 | Ruppert et al. ..... 131/70 |
| 5,617,943 | A | | 4/1997 | Belvederi et al. |
| 5,666,975 | A | | 9/1997 | Lord |
| 5,666,976 | A | * | 9/1997 | Adams et al. ..... 131/94 |
| 5,687,747 | A | | 11/1997 | Schramm |
| 5,713,377 | A | | 2/1998 | Gerding et al. |
| 5,730,159 | A | | 3/1998 | Draghetti et al. |
| 5,743,067 | A | * | 4/1998 | Trimani ..... 53/151 |
| 5,860,427 | A | * | 1/1999 | Stivani et al. ..... 131/281 |
| 5,979,458 | A | * | 11/1999 | Meis ..... 131/283 |
| 6,345,624 | B1 | | 2/2002 | Kastner |
| 6,357,201 | B1 | * | 3/2002 | Focke et al. ..... 53/167 |
| 6,431,812 | B1 | | 8/2002 | Budny |
| 6,484,867 | B2 | * | 11/2002 | Spatafora et al. ..... 198/418.1 |
| 6,571,800 | B1 | | 6/2003 | Yu |
| 6,739,343 | B1 | | 5/2004 | Trinkies et al. |
| 6,786,123 | B1 | | 9/2004 | Chen |
| 6,913,022 | B2 | | 7/2005 | Moser et al. |
| 6,978,789 | B2 | | 12/2005 | Garbarino |
| 2001/0047806 | A1 | * | 12/2001 | Spatafora et al. ..... 131/282 |
| 2004/0099277 | A1 | | 5/2004 | Moser et al. |
| 2004/0129281 | A1 | | 7/2004 | Hancock et al. |
| 2004/0163656 | A1 | * | 8/2004 | Okamoto ..... 131/58 |
| 2004/0255965 | A1 | | 12/2004 | Perfetti et al. |
| 2005/0098185 | A1 | * | 5/2005 | Steiniger ..... 131/65 |
| 2005/0103175 | A1 | | 5/2005 | O'Banion et al. |
| 2005/0229941 | A1 | | 10/2005 | Minami et al. |
| 2006/0021625 | A1 | | 2/2006 | Nyffeler |
| 2006/0027243 | A1 | | 2/2006 | Matsufuji et al. |
| 2006/0096604 | A1 | | 5/2006 | Moser et al. |

FOREIGN PATENT DOCUMENTS

| | | | |
|---|---|---|---|
| CA | 973048 | | 8/1975 |
| CA | 1039603 | | 10/1978 |
| EP | 0 144 060 | | 6/1985 |
| EP | 1 177 731 | A2 | 2/2002 |
| EP | 1 330 960 | B1 | 10/2005 |
| GB | 15535 | | 00/1914 |
| GB | 29777 | | 00/1914 |
| GB | 2 187 076 | A | 9/1987 |
| JP | 60-087117 | | 5/1985 |
| WO | WO 2004/110187 | A2 | 12/2004 |
| WO | WO 2006/102763 | A1 | 10/2006 |
| WO | WO 2007/082939 | A1 | 7/2007 |

OTHER PUBLICATIONS

U.S. Appl. No. 11/281,083, filed Nov. 17, 2005, Barnes et al.
U.S. Appl. No. 11/375,700, filed Mar. 14, 2006, Thomas et al.
Instructions for using the Supermatic II, 4 pages.
Package insert for Machine A Cigarettes Excel Cigarette Machine, 2 pages.
Package insert for Easy Roller, 4 pages.
Package insert for How to use your Bugler Cigarette Making Machine, 2 pages.
Package insert for Escort, 2 pages.
Package insert for Presta, 2 pages.
Supermatic Parts List, 2 pages.
Detroit Tobacco Corporation Web Site, www.detroittobacco.com, visited Mar. 24, 2006, 17 pages.
Package insert for Premier Twin Double Cigarette Tube Filling Machine, 2 pages.

* cited by examiner

APPARATUS AND METHODS FOR MANUFACTURING CIGARETTES

FIELD OF THE INVENTION

The present invention relates to smoking articles, and in particular, to cigarettes. More specifically, the present invention relates to equipment and methods for manufacturing and handling relatively small quantities of cigarettes in an automated fashion.

BACKGROUND OF THE INVENTION

Smoking articles, such as cigarettes, have a substantially cylindrical rod-shaped structure and include a charge, roll, or column of smokable material, such as shredded tobacco, surrounded by a paper wrapper, to form a "cigarette rod," "smokable rod," or a "tobacco rod." A typical cigarette has a cylindrical filter element axially aligned in an end-to-end relationship with the tobacco rod. Typically, the filter element comprises plasticized cellulose acetate tow circumscribed by a paper material known as "plug wrap." Certain cigarettes incorporate filter elements comprising, for example, activated charcoal particles. Typically, the filter element is attached to one end of the tobacco rod using a circumscribing wrapping material known as "tipping paper." A ventilated or air-diluted smoking article can be provided with an optional air-dilution means, such as a series of perforations, each of which extend through the tipping material and plug wrap. Conventional automated machines for making cigarette rods that have been employed for the manufacture of commercially popular packaged cigarettes are of the type commercially available from Molins PLC or Hauni-Werke Korber & Co. KG. For example, a description of a commercially available "Protos" cigarette-making machine is provided in U.S. Pat. No. 4,474,190 to Brand. Other types of equipment suitable for the manufacture of cigarettes are set forth in U.S. Pat. App. Pub. No. 2004/0129281 to Hancock et al. A cigarette-making machine for making relatively small amounts of cigarettes has been available commercially as "Hauni Baby" from Hauni-Werke Korber & Co. KG. Another type of portable cigarette-making machine has been set forth in U.S. Pat. No. 4,164,229 to Hurt.

Cigarettes are commercially available in a wide variety of types. For example, different brands of cigarettes are available containing different individual types of tobaccos having unique or characteristic flavors and aromas (e.g., Burley, Oriental, and Virginia tobaccos). Cigarettes are also available that contain blends of tobacco types and/or flavoring agents in or on the tobacco. Different colors and flavors of wrappers and different types of filter elements are available providing variety in, for example, flavoring, strength of flavor, and tar yield. Conventionally, consumers obtain commercially available cigarettes in a pack containing a single type of cigarette. Thus, consumers wishing to smoke different types of cigarettes typically have to purchase multiple packs of cigarettes. Some consumers purchase wrapping materials, filters, and loose tobacco for so-called "hand-rolling" of their own cigarettes. While this approach allows a consumer to produce a variety of his own cigarettes, the making process requires a certain degree of skill, time, inconvenience, and/or some specialized equipment. A variety of hand-operated devices for manufacturing individual cigarettes have been proposed. See, for example, U.S. Pat. Nos. 2,376,103 to Wahl; 2,425,888 to Matteson et al.; 2,427,884 to Snodgrass; 2,427,957 to Getts; 2,496,375 to Carter; 2,594,747 to DuLaney; 2,699,788 to Kastner; 2,714,383 to Ming Gee; 2,731,971 to Kastner; 2,850,019 to Sosa; 2,868,209 to Marcotte; 3,006,348 to Banning, Jr.; 3,011,498 to Armelin; 4,832,056 to Bryant et al.; and 4,534,367 to Newsome; PCT Application Pub. No. WO 2004/110187 to Szabo; and European Patent No. EP 1,177,731 to Tinkles et al.

Various methods for filling paper cigarette tubes with tobacco have been proposed. See, for example, U.S. Pat. Nos. 2,633,133 to Higgins; 3,124,141 to Seitter; 3,202,156 to Kappeler et al.; 3,892,245 to Asbill, Jr.; 4,167,948 to Moscovitch; 4,572,216 to Josuttis et al.; and 5,072,740 to Gatschmann et al. See, also, U.S. Pat. Nos. 3,491,768 to Paynter and 3,693,313 to Sexstone which set forth manners and methods for manufacturing individual cigarettes by filling a tube, or "spill," with a tobacco charge and a filter plug. One type of cigarette-making machine for the manufacture of one cigarette at a time using loose tobacco and a filtered cigarette tube has been marketed as "BUGLER™" filter cigarette-making machine by Brown & Williamson Tobacco Corporation. Another type of automated machine for filling pre-formed cigarette tubes with loose tobacco filler has been available commercially as "Cig-a-mat" from Jenkins & Ott, Inc. A device representative of such a machine is described in U.S. Pat. No. 3,645,272 to Jenkins et al. Yet another type of automated device for filling pre-formed cigarette tubes with tobacco filler is an electrically-operated cigarette-making machine that has been available commercially as "Easy Roller" from C. P. Rolling ApS of Denmark.

Another cigarette machine for filling pre-formed cigarette tubes with tobacco filler has been produced commercially by The Central Tobacco Mfg. Co. Ltd. and marketed as "PREMIERE SUPERMATIC™." Other types of cigarette machines for filling cigarette tubes with tobacco have been marketed as "Escort" and "Pressta Deluxe" by CTC Canada Inc. See, for example, the representative types of machines set forth in U.S. Pat. No. 3,127,900 to Kastner and U.S. Pat. No. 4,771,793 to Kastner.

U.S. Pat. No. 3,822,710 to Bramhill proposes manufacturing individual cigarettes by inserting a cartridge of tobacco into an empty filter-tip cigarette tube. Other manners and methods for manufacturing individual cigarettes are set forth in U.S. Pat. Nos. 4,887,617 to Ruppert et al.; 5,018,536 to Liebich; 5,105,830 to Brackmann et al.; 5,133,366 to Liebich; 5,141,000 to Ruppert et al.; 5,167,248 to Ruppert et al.; 5,197,495 to Ruppert et al.; 5,615,692 to Ruppert et al.; and 5,713,377 to Gerding et al.; and U.S. Pat. App. Pub. No. 2006/0021625 to Nyffeler.

Other methods for manufacturing small quantities of cigarettes, for example 20 cigarettes, in an automated fashion by filling paper cigarette tubes are disclosed in co-pending U.S. patent application Ser. No. 11/143,889, filed Jun. 1, 2005, to Thomas et al., and Ser. No. 11/281,083, filed Nov. 17, 2005, to Barnes et al., each of which applications is incorporated herein by reference is its entirety. A representative device for manufacturing cigarettes disclosed in these applications can include a reservoir for containing loose tobacco filler, a means for delivering a portion of the tobacco filler into pre-formed tubular wrappers, and a means for controlling the portion of the tobacco filler delivered into the wrappers, such as a compression mechanism for arranging tobacco filler into a charge of tobacco filler of pre-determined shape and size or a means for controlling the rate of movement of the wrappers as they are being filled. The device can include a tray or cartridge for containing a plurality of the tubular wrappers, which can be aligned with corresponding receptacles, and an insertion means, such as plunger rods or auger conveyors, for delivering each charge of tobacco filler from a receptacle into a wrapper. The cartridge, filled with manufactured cigarettes, can be removed from the cigarette-making device, excess tobacco can be cut away from the ends of the cigarettes with a cutting device, and the cigarettes can be transferred from the cartridge into a cigarette packaging device. As such, a small lot of cigarettes of consistent quality (for example, in terms of components, dimensions, and weight) are produced. The device can be employed in a commercial setting such that a customer can choose a type or blend of tobacco filler for a package of cigarettes. For other manners and methods of manufacturing small quantities of cigarettes, see also co-pending U.S. patent application Ser. No. 11/375,700, filed Mar. 14, 2006, to Thomas et al.

Yet other manners and methods for fabricating cigarettes have been proposed. For example, the manufacture of cigarettes has been proposed using a dispensing-type machine, such as the machine referred to as "Cigaretterie," marketed by National Amusement Network, Inc. A device representative of such a machine is set forth in U.S. Pat. No. 5,666,975 to Lord.

It would be desirable to provide for the manufacture of relatively small lots of cigarettes in an efficient and effective manner. It would be desirable that all of the cigarettes within each lot are of consistent quality. That is, it would be desirable that all of the cigarettes within such a lot be substantially identical to one another in appearance, size, shape, weight, and component materials, including tobacco filler materials. It also would be desirable that the cigarettes within such a lot exhibit similar performance characteristics, such as smoking character, puff count, and smoke yield. Alternatively, it may be desirable to efficiently and effectively manufacture simultaneously a plurality of cigarettes with different smoking characteristics (for example, flavors, tobacco types), all while maintaining consistent smoking quality of the cigarettes.

SUMMARY OF THE INVENTION

The present invention relates to the manufacture of cigarettes in an automated fashion. Cigarette manufacture can be carried out such that relatively small lots of cigarettes can be manufactured during a relevant period, for example, while a customer is shopping in a retail setting. Cigarette manufacture can be carried out such that substantially all of the cigarettes within a lot are of consistent quality. In an embodiment, a cigarette making apparatus and/or method for manufacture of cigarettes of the present invention can provide a plurality of cigarettes, preferably at least two cigarettes, and most preferably at least three cigarettes. The number of cigarettes that such a cigarette making apparatus can make can vary. For example, an embodiment of such an apparatus can make 25 or more cigarettes. In a preferred embodiment, the apparatus can make 20 cigarettes simultaneously.

A first aspect of the present invention relates to an apparatus or device for manufacturing a small lot of cigarettes from a charge of tobacco filler. The device can include a supply of wrapping paper and a means for providing a desired amount of tobacco filler about which the wrapping paper is wrapped. In a preferred embodiment, a desired amount of tobacco filler can be provided in the form of a pre-formed cylinder of tobacco (or tobacco cartridge). The apparatus can include a garniture for forming a predetermined length of wrapping paper about the charge of tobacco filler with a forming mechanism to form a cigarette rod. The apparatus includes a means for delivering the charge of tobacco filler from a supply of tobacco filler to the garniture. For example, the means for delivering the charge of tobacco filler to the garniture may comprise a tobacco cartridge delivery mechanism (or rod) that is positioned for sliding movement through a tobacco cartridge hopper for pushing a tobacco cartridge onto wrapping paper in the garniture. The wrapping paper can be supplied from a bobbin operably associated with the apparatus. In a preferred embodiment, the bobbin is removable from the apparatus so that a supply of wrapping paper can be placed on the bobbin when desired, for example, when the bobbin is empty of paper. The garniture forming mechanism can be adapted to be movable along the garniture. The wrapping paper can be supplied to the garniture by either manual or automated components, for example, a movable garniture belt.

A second aspect of the invention relates to cutting a cigarette rod formed in the garniture into a plurality of individual cigarettes. An embodiment of the apparatus can include a means for cutting the cigarette rod in a manner perpendicular to the longitudinal axis of the rod to form a desired plurality of cigarettes. For example, the cutting means can comprise a cutting device located adjacent the garniture and positioned for cutting the cigarette rod into the plurality of cigarettes after the cigarette rod is formed in the garniture. A representative embodiment of the invention can include a plurality of circular cutting blades rotatable at a high speed that can be passed through the cigarette rod to cut the rod into cigarettes. Embodiments of the invention can include a means to transfer the cigarette rod from the garniture to the cutting device.

A third aspect of the invention relates to making a long cigarette rod having a finite length formed in a discrete process separate from the process for cutting the cigarette rod into a plurality of cigarettes. For purposes herein, finite length means a length having a beginning and an ending. The cigarette manufacturing apparatus operates to form such a long cigarette rod (that is, sufficiently long to provide a small plurality of cigarettes) in one operation in the garniture. The cigarette rod thusly formed has a finite length having a beginning and an end. That is, the cigarette rod is not connected to other cigarette rods that may be made by the apparatus. Once the finite length cigarette rod is formed in the garniture, the rod is transferred to the means for cutting the cigarette rod. In another, separate operation of the cigarette manufacturing apparatus, the cigarette rod cutting means can be utilized to cut the finite length cigarette rod into a plurality of cigarettes simultaneously. Thus, a cigarette manufacturing apparatus according to the present invention can make cigarettes from a cigarette rod having a finite length in at least two separate operations, as compared to the formation and cutting of a continuous cigarette rod in one ongoing, or simultaneous, operation used in commercially available cigarette manufacturing equipment. In an embodiment of the present invention, cigarettes can be made from the finite length cigarette rod in an end-to-end relationship.

A fourth aspect of the present invention relates to a means for transferring the cigarettes from the cutting means to a tipping device, a packaging device, and/or other device for preparing the cigarettes for a consumer. In an illustrative embodiment, the transferring means can include a means for orienting the cigarettes in the cutting device by turning the cigarettes approximately 90 degrees to place the cigarettes in side-by-side alignment. The transferring means can further include a means for moving the aligned cigarettes from the cutting device to a tipping device and/or a packaging device. The means for moving the cigarettes can include a set of cigarette ejector rods that can eject the cigarettes from the cutting device to a cigarette tray. The cigarette tray can be configured to hold a plurality (for example, twenty) cigarettes for transfer to a tipping device and/or a packaging device.

A fifth aspect of the present invention relates to an apparatus or device for adding filter elements to the cigarettes manufactured utilizing a cigarette manufacturing apparatus according to the present invention. The cigarettes can be transferred in the cigarette tray from the cutting device to a tipping device where filter elements can be added to the cigarettes in various manners. An embodiment of the present invention can provide a small quantity of cigarettes that are air-diluted. For example, a filter element having a porous plug wrap can be applied to a manufactured cigarette rod in the tipping device. The tipping material for securing the filter element to the cigarette rod can be pre-perforated. In this manner, each of the small plurality of cigarettes can include a means for introducing air dilution to the cigarette.

A sixth aspect of the present invention is directed to the use of the various components associated with various aspects of the present invention as a system to provide a cigarette product manufacturing assembly for making a small quantity of cigarettes. In an exemplary embodiment, a specific tobacco filler blend can be selected. In addition, particular wrapping paper can be selected. Cigarettes can be manufactured by delivering at least one charge of tobacco filler (for example, the selected tobacco filler blend) from a supply of tobacco filler onto a predetermined length of wrapping paper in a garniture. The wrapping paper can be formed about the charge of tobacco filler by a forming mechanism in the garniture. The cigarette rod formed therefrom can be to moved to a cutting device, and the cigarette rod can be cut into a plurality of individual cigarettes. As such, numerous cigarettes of consistent quality (for example, in terms of the same tobacco filler, wrapping paper, and dimensions) are produced. The cigarette tray, filled with manufactured cigarettes, can be removed from the cigarette manufacturing apparatus and transferred to a tipping device for adding filter elements, which may have air dilution capabilities, to the cigarettes. The cigarettes can be transferred from the cigarette tray into the cigarette packaging device, where the cigarettes are loaded into a package. For example, one embodiment of the invention can include a device having a base that has a region for locating an open cigarette package. The device includes an upper region or platform, above the base, adapted to support a cigarette tray containing finished cigarettes. Below the upper platform is located a downwardly extending passageway for the passage of cigarettes from the cigarette tray and into the cigarette package. Removal of cigarettes from the cigarette tray can be accomplished by movement of the tray relative to the upper platform such that cigarettes within the tray are pushed from the tray and into the downwardly extending passageway, traveling thereby into the package. As such, embodiments of the present invention provide a manner or method for manufacturing and packaging relatively small quantities, lots, or batches of finished cigarettes in an automated fashion.

Although useful in many environments, an automated cigarette manufacturing apparatus, a tipping device, and a packaging device according to the present invention may be utilized in combination with all or certain of the foregoing devices, for example, for the manufacture of cigarettes for personal use (for example, for use at home) and for the manufacture of specialty type cigarettes within tobacco products retail establishments (for example, for the production of individual packages of cigarettes at tobacco shops). In this way, a customer can choose a type or blend of tobacco filler for a package of cigarettes, and view the production and handling of the cigarettes that are produced expressly for that customer. An automated cigarette manufacturing apparatus, a tipping device, and a packaging device according to the present invention may be used in combination for the manufacture of small lots of cigarettes for quality control or regulatory related activities, or for research and development purposes.

In one aspect of the invention, one lot of cigarettes made from a cigarette rod may vary from another lot, in that a particular lot may include a different selection of tobaccos, blends, and/or flavors than in another lot. The act of selection may include selecting from different tobacco types (including individual tobaccos for use alone or in blends, or from blends provided). The differences in particular lots of cigarettes may include, for example, one or more of flavored wrappers, flavored tobaccos, different colored wrappers, different species of tobacco, different blends of tobacco, or different filter profiles. In such an embodiment, the different lots of cigarettes can include visual indicia correlated to one or more of their characteristics.

Embodiments of the present invention can include a method for manufacturing cigarettes utilizing the various embodiments of a cigarette manufacturing apparatus described herein.

As will be realized by those of skill in the art, many different embodiments of an apparatus and methods for manufacturing cigarettes according to the present invention are possible. Additional uses, objects, advantages, and novel features of the invention are set forth in the detailed description that follows and will become more apparent to those skilled in the art upon examination of the following or by practice of the invention.

DETAILED DESCRIPTION OF THE PREFERRED EMBODIMENTS

The present invention provides embodiments of an automated device or apparatus for manufacturing a small quantity of smokable rods, for example, cigarettes. The apparatus utilizes a garniture for forming a cigarette rod. The apparatus can include a supply of wrapping paper, or web, for wrapping about a supply of tobacco filler. The tobacco filler can be in the form of a pre-formed cartridge of tobacco filler. A predetermined amount of the tobacco filler is delivered onto a predetermined length of the wrapping paper in the garniture region. The garniture can include a forming mechanism for forming the wrapping paper about the tobacco filler and a means for sealing the wrapping paper onto itself to thereby form a cigarette rod. The cigarette rod may be sealed while maintained in a stationary position in the garniture, or the wrapping paper and tobacco filler may be moved in the garniture for sealing the paper onto itself. The cigarette rod forming process can be initiated for forming a single, finite length cigarette rod and stopped when that rod is formed. The apparatus can include a means for cutting the cigarette rod into individual cigarettes. The apparatus provides for making a cigarette rod having a finite length (sufficient to make a predetermined number of cigarettes) formed in a discrete process separate from the process for cutting the cigarette rod into a plurality of cigarettes. The apparatus can include a means for orienting the individual cigarettes, and/or a means for moving the cigarettes from the cutting means. The small lot of cigarettes can thus be transferred to a tipping device where a mouth piece such as a filter, which may have air dilution capabilities, can be added to one end of each cigarette. The cigarettes having a mouth piece added from the tipping device can then be transferred to a packaging device for packaging the cigarettes for a consumer. The various embodiments of the present invention may include components and/or features described in co-pending U.S. patent application Ser. No. 11/143,889, U.S. patent application Ser. No. 11/375,700, and U.S. patent application Ser. No. 11/281,083, each of which is incorporated herein by reference in its entirety.

Figure 1:
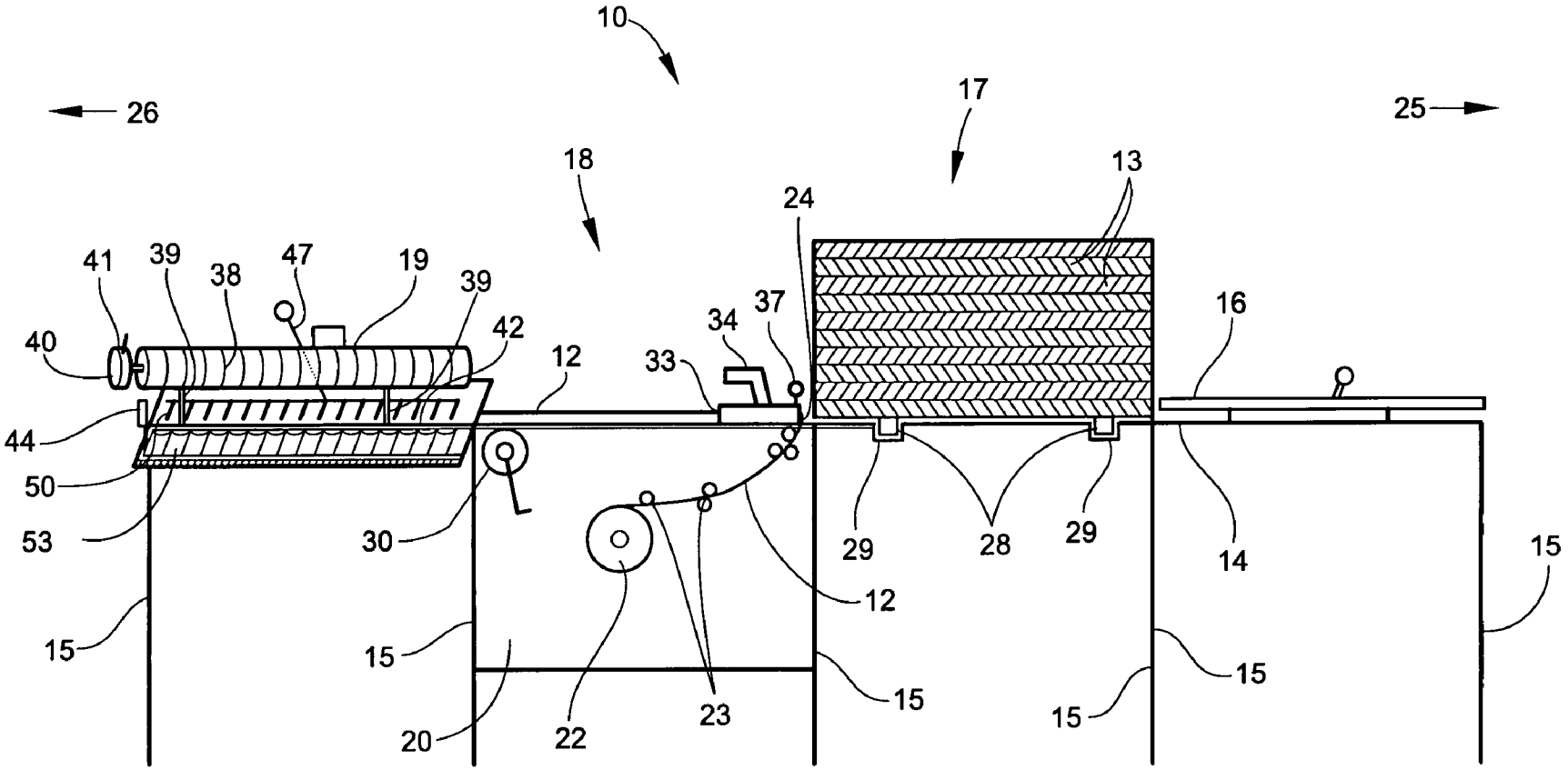
FIG. 1 is a diagrammatic view of a cigarette making apparatus in an embodiment of the present invention.

Referring to FIG. 1, there is shown an embodiment of an automated cigarette manufacturing apparatus 10 of the present invention for manufacturing a plurality of cigarettes 11. In this embodiment, a cigarette rod is formed by wrapping a wrapping paper, or web, 12 about a pre-formed tobacco filler cartridge 13 have a finite length. For the embodiment shown in FIG. 1, the automated cigarette-making apparatus 10 is designed to simultaneously manufacture a plurality of cigarettes 11, preferably at least two cigarettes 11 and most preferably at least three cigarettes 11. In an embodiment, the number of cigarettes 11 that such a cigarette making apparatus 10 can make can vary. For example, an embodiment of such an apparatus 10 can make at least two cigarettes 11, preferably 5, 10, 20, or 40 or more cigarettes 11 at one time. An embodiment of such an apparatus 10 can make up to 20, 30, or 40 cigarettes at one time. When the wrapping paper 12 is wrapped and sealed about the tobacco cartridge 13, a cigarette rod is formed. The simultaneous manufacture of a plurality of cigarettes 11 can be accomplished by wrapping the wrapping paper 12 about a tobacco cartridge 13 having a length sufficient to provide the desired plurality of cigarettes 11 when the cigarette rod formed therefrom is subdivided into individual cigarettes 11.

The cigarette manufacturing apparatus 10 includes an operating platform, or base 14, which can be manufactured from a suitable material, such as metal (for example, stainless steel, brass, or aluminum), plastic (for example, polycarbonate, polymethylmethacrylate, acrylate/butadiene/styrene, or ABS type plastic, nylon, or other suitable polymeric material), composite material (for example, a graphite-based ceramic), or like material. Preferably, the base 14 is manufactured from aluminum.

The base 14 serves as a platform for positioning and operating the other components of the cigarette manufacturing apparatus 10. The base 14 preferably includes legs 15, as shown in FIG. 1, to support the base 14 above a surface, such as a countertop, on which the apparatus 10 rests. The base 14 can be configured to accommodate a means 16 for delivering tobacco filler to a garniture 18, a tobacco filler cartridges supply hopper 17, and a cutting device 19 all in an end-to-end arrangement. Alternatively, the tobacco filler delivery mechanism 16 can be located in parallel with, for example, to the side of or underneath, the tobacco cartridge hopper 17, and/or the cutting device 19 can be located in parallel with, for example, to the side of, the garniture 18. The shape and dimensions of the base 14 can vary, and can be a matter of design choice. In the end-to-end configuration shown in FIG. 1, each of the means 16 for delivering tobacco filler to the garniture 18, tobacco filler cartridge hopper 17, garniture 18, and cutting device 19 can be approximately one meter long such that the entire base 14 is about four meters in length or longer. In an embodiment, components of the cigarette making apparatus 10, such as a bobbin support frame 20 and the means 21 for orienting cigarettes 11 in the cutting device 19, can be integrally formed as part of the base 14.

In embodiments of the present invention, various components of the cigarette manufacturing apparatus 10 can be covered with an aesthetically pleasing cover (not shown). For example, portions of the base 14 can be adapted to support an optional formed plastic cover of a desired design and color.

The wrapping material 12 employed as the outer wrapping material 12 of the smokable rods most preferably is provided from a supply roll or bobbin 22. Bobbins are often used to supply such types of wrapping materials 12 for the production of cigarette rods. The selection of exemplary types of bobbins 22, techniques for supporting those bobbins 22, and techniques for removing wrapping material 12 from bobbins 22 will be apparent to those skilled in the art of cigarette design and manufacture. See, for example, the types of bobbins and related technologies referenced in U.S. Pat. Application Nos. 2005/0076929 to Fitzgerald et al. and 2005/0115575 to Seymour et al., each of which is incorporated herein by reference.

In the embodiment in FIG. 1, the online bobbin 22 from which wrapping paper 12 is fed to the garniture 18 is attached to the bobbin support frame 20. The bobbin support frame 20 extends downward from the base 14 platform below the garniture 18. The bobbin support frame 20 can be manufactured from a suitable material, such as aluminum. The bobbin support frame 20 can be connected to the base 14 using an appropriate fastening means. For example, screws may be threaded through the bobbin support frame 20 into the bottom face of the base 14. Alternatively, the bobbin support frame 20 can be integrally formed with the base 14. The bobbin support frame 20 can be adapted to support the bobbin 22.

In the embodiment in FIG. 1, the small bobbin 22 is attached to the bobbin support frame 20 by means of a rotatable shaft extending perpendicularly from the support frame 20. The wrapping paper 12 wound about the bobbin 22 is threaded through a series of idler rollers 23 en route to the garniture 18. The wrapping paper 12 is held down on the bobbin 22 with an idler roller 23. The rotatable shaft has a sufficient amount of pull resistance, which in combination with the idler rollers 23, helps maintain appropriate tension on the wrapping paper 12 so as to avoid creating slack in the paper 12 as it is being pulled to the garniture 18.

The wrapping paper 12 can be pulled from the bobbin 22 onto the upper surface of the garniture 18. As shown in FIG. 1, the wrapping paper 12 can be pulled through a paper opening 24 in the proximal end 25 of the garniture 18 to the distal end 26 of the garniture 18 into position to receive a charge of tobacco filler 27. The wrapping paper 12 may be pulled onto the garniture 18 upper surface by an appropriate paper unloading means 30.

Preferred wrapping materials 12 of the cigarettes 11 described herein encompass a wide range of compositions and properties. The selection of a particular wrapping material 12 will be readily apparent to those skilled in the art of cigarette design and manufacture. The most preferred cigarettes 11 have a single layer of wrapping material, paper, or web 12. Exemplary types of wrapping materials 12, wrapping material components, and treated wrapping materials are described in U.S. Pat. No. 6,779,530 to Kraker; U.S. Published Pat. Apps. 2005/0016556 to Ashcraft et al.; 2005/0076929 to Fitzgerald et al.; 2006/0021625 to Nyffeler; and U.S. patent application Ser. No. 11/251,632, filed Oct. 14, 2005 to Oglesby; each of which is incorporated herein by reference in its entirety.

In one aspect of the present invention, the cigarette manufacturing apparatus 10 includes providing a supply of tobacco filler 27 about which wrapping paper 12 is wrapped to form a cigarette rod. The tobacco 27, preferably in cut filler form, can be provided in a generally rod-shaped or cylindrical form. Tobacco 27 provided in such a form has been referred to as a "tobacco cartridge" 13. A representative tobacco cartridge 13 possesses a pre-portioned amount of tobacco filler 27 contained in a tubular casing, for example, a fine mesh type of casing, comprising a highly porous or air permeable material. The tobacco cartridge 13 form is adapted so as to maintain the configuration of the tobacco filler 27 so that the tobacco filler 27 can be wrapped inside wrapping paper 12 to form a cigarette rod. Generally, the tobacco filler cartridge 13 is not smokable until after being wrapped by the cigarette wrapping paper 12. Although the tobacco cartridge 13 casing material is not a cigarette wrapping material 12, it does not negatively affect the smoking characteristics of a cigarette 11 made from a cartridge 13 possessing such a porous casing. The tobacco cartridge casing provides a means by which the integrity of an appropriately proportioned amount of tobacco filler 27 having a particular packing density can be maintained for storage, collection, transport, and otherwise handling during the manufacture of cigarettes 11.

For equipment and methods of making tobacco filler cartridges 13, see, for example, U.S. Pat. Nos. 3,822,710 to Bramhill; 4,887,617 to Ruppert et al.; 5,018,536 to Liebich; 5,105,830 to Brackman et al.; 5,133,366 to Liebich; 5,141,000 to Ruppert et al.; 5,167,248 to Ruppert et al.; 5,197,495 to Ruppert et al.; 5,615,692 to Ruppert et al.; and 5,713,377 to Gerding et al., each of which is incorporated herein by reference. Representative tobacco filler cartridge assemblies and components have been commercially available in Canada, for example, by Rothmans, Benson & Hedges Inc. under the trade name "Belvedere." Cartridges, devices, and methods described therein are expected to be useful with certain applications of the present invention. Other equipment and methods for manufacturing tobacco filler cartridges 13 will be apparent to those skilled in the art of cigarette design and manufacture. For example, a conventional cigarette manufacturing machine may be adapted to deposit tobacco filler 27 into a fine mesh casing to form a tobacco filler cartridge 13.

In an embodiment of the present invention, the manufactured cigarette rod comprises a finite length sufficient for making a plurality of cigarettes 11 from that rod. Conventional devices and methods are generally designed for making a tobacco filler cartridge 13 for an individual cigarette 11. Such conventional devices and methods can be suitably modified to make a tobacco filler cartridge 13 having a length sufficient for making a plurality of cigarettes 11 from a cigarette rod formed from such a cartridge 13. Accordingly, cigarette manufacturers can utilize conventional equipment and techniques to provide long tobacco cartridges 13 for use in an embodiment of the present invention without affecting the desirable characteristics of the tobacco filler 27 within the cartridges 13.

A long tobacco cartridge 13 useful in embodiments of the present invention has qualities and characteristics similar to a tobacco cartridge for making an individual cigarette 11. Such qualities and characteristics include, for example, the manners and methods of manufacturing the tobacco cartridge 13, the types and proportions of materials incorporated into the cartridge 13, diameter of the cartridge 13, and the overall nature of the cartridge 13. However, a tobacco cartridge 13 useful in embodiments of the present invention has a finite length for making a cigarette rod of sufficient length for making a plurality of cigarettes 11 therefrom. In addition, a tobacco cartridge 13 useful in embodiments of the present invention has sufficient integrity and resiliency so as to not be deformed or fall apart during handling and in the manufacture of cigarettes 11.

The tobacco filler cartridge 13 preferred for use for manufacturing cigarettes 11 in a cigarette manufacturing apparatus 10 of the present invention can be encased in a thin, highly porous, mesh wrap material. The thin mesh wrap material may be treated with formulations incorporating ethylcellulose, starch, alginate, or the like (for example, to affect properties such as flavor, burn rate, porosity). Representative manners and methods for treating such wrapping materials with additive materials are set forth in U.S. Pat. No. 6,779,530 to Kraker; U.S. Published Pat. Apps. 2005/0016556 to Ashcraft et al.; 2005/0076929 to Fitzgerald et al.; 2006/0021625 to Nyffeler; and U.S. patent application Ser. No. 11/251,632, filed Oct. 14, 2005 to Oglesby; each of which is incorporated herein by reference. Preferably, that mesh wrap material is so thin and highly meshed, or porous, that the tobacco material 27 within is visible. Thus, a cigarette manufacturer and/or a customer can visualize the nature, character, and form of the tobacco filler 27 through the mesh wrap material.

In an embodiment of the tobacco cartridge 13 that does not include a thin, porous outer material, the cartridge 13 preferably maintains a generally cylindrical shape. In such an embodiment, the tobacco 27 can be held together by, for example, binding agents and/or mechanical compression. The size and shape of the tobacco cartridge 13 is sufficient to allow it to be readily wrapped inside the wrapping paper 12, and to provide a finished cigarette 11 that exhibits desirable performance characteristics. As such, the tobacco filler 27 to be wrapped preferably is provided in a form of predetermined size and shape, and its overall size and shape preferably is maintained to a significant extent after being wrapped.

In the present invention, an embodiment of the tobacco filler cartridge 13 comprises a rod of tobacco filler 27 of finite length. For example, the length of a tobacco cartridge 13 for making 20 individual cigarettes 11 may be between about 70 cm and about 150 cm (approximately ¾-1.5 meters). To manufacture a lot of 20 cigarettes 11 each having a preferred length of 57 mm (without a filter), the tobacco cartridge 13 is at least approximately 114 cm in length. The actual length of the tobacco cartridge 13 may be slightly longer than the cumulative end-to-end length of the number of cigarettes 11 to be made. This allows for excess amounts of the cigarette rod and the tobacco cartridge 13 contained within to be trimmed off each end of the long cigarette rod. Preferably, the amount of any excess trimmed from the cigarette rod is kept to a minimum so as to produce each of the plurality of cigarettes 11 having essentially the same size, shape, and appearance.

In one illustrative embodiment, the tobacco filler cartridge 13 can be a length sufficient to provide a desired plurality of cigarettes 11 when the cigarette rod formed from the wrapped cartridge 13 is cut. In another embodiment, a number of tobacco cartridges 13 each having a length equivalent to the desired length of the tobacco portion of a finished cigarette 11 can be provided to the garniture 18 for wrapping within a predetermined length of wrapping paper 13 approximately equal to the cumulative end-to-end length of the number of cigarettes 11 to be made. In this manner, the cigarette rod formed by wrapping the number of individual tobacco cartridges 13 can be cut at locations corresponding to the ends of the individual tobacco cartridges 13 to form the desired plurality of cigarettes 11. Such an embodiment provides for ease of handling a pre-portioned amount of tobacco filler 27 and a quick way to manufacture a small quantity of cigarettes 11 from a cigarette rod having a finite length.

The tobacco filler cartridges 13 can be supplied in the cigarette making apparatus 10 in a removable tobacco cartridge hopper 17. Such a tobacco cartridge hopper 17 can be removably mounted on the base 14 adjacent the proximal end 25 of the garniture 18. The tobacco cartridge hopper 17 includes a vertical chamber configured to hold tobacco cartridges 13. It should be appreciated that, in other embodiments, the chamber may be angled rather than vertical, and/or may be wider at the top than at the bottom (for example, to hold more tobacco cartridges 13). In the illustrated embodiment of FIG. 1, the chamber holds a plurality of tobacco cartridges 13 in a single-file vertical column. The bottom of the chamber allows passage (for example, by gravity-feed) of the tobacco cartridges 13 into position for delivery to the garniture 18.

The tobacco cartridge hopper 17 can be adapted to be capable of being maintained firmly in place relative to the base 14 during periods when cartridges 13 are being delivered to the garniture 18. Desired secure positioning of the removable tobacco cartridge hopper 17 within the base 14 can be accomplished by any suitable means. For example, the tobacco cartridge hopper 17 may be horizontally secured to the base 14 using, for example, a pin or key type of design, for example, one or more hopper locator pins 28. Preferably, two or more hopper locator pins 28 extend downwardly from the bottom of the tobacco cartridge hopper 17 and cooperate with a coordinating hole 29 located at a predetermined location in the upper surface of the base 14. The combination of the hopper locator pins 28 and base coordinating holes 29 provide for a convenient manner of positioning of the tobacco cartridge hopper 17 securely in a desired position relative to the base 14 such that the cartridges 13 can be accurately delivered to the garniture 18. In an alternative embodiment, the tobacco cartridge hopper 17 may be movable (not shown). For example, a movable tobacco cartridge hopper 17 may be placed directly over the garniture 18 and a tobacco cartridge 13 dispensed onto a length of wrapping paper 12 in the garniture 18 for forming a cigarette rod.

In the present invention, a tobacco filler cartridge 13 is the preferred means for providing a charge of tobacco filler 27 onto a finite length of wrapping paper 12 in the garniture 18 for forming a cigarette rod. In an alternative embodiment, tobacco filler 27 can be provided to the garniture 18 using other means. For example, loose tobacco filler 27 can be sprinkled or dropped onto wrapping paper 12 in the garniture 18, or otherwise applied to the wrapping paper 12 in a controlled manner. Appropriate means for providing tobacco filler 27 to the garniture 18 will be readily apparent to those skilled in the art of cigarette design and manufacture.

In one such alternative embodiment, the tobacco filler 27 can be supplied onto the wrapping paper 12 in the garniture 18 in loose form. In such an embodiment, the loose tobacco filler 27 can be supplied in various ways. For example, loose tobacco filler 27 can be provided in a removable hopper (not shown) that is positioned on the base 14 adjacent the proximal end 25 of the garniture 18. The loose tobacco filler hopper can be manufactured from any suitable metallic material, such as aluminum. The loose filler hopper can be held securely in position on the base 14 in a manner similar to how the tobacco cartridge hopper 17 can be held in position on the base 14. For example, the desired secure positioning of the removable loose filler hopper relative to the base 14 can be facilitated by placement of protruding pins on the bottom of the loose tobacco filler hopper and complementary mating holes in the top of the base 14. By use of the pin/hole arrangement or another suitable mechanism, the loose filler hopper can be appropriately aligned with the other components of the cigarette manufacturing apparatus 10. By aligning the loose filler hopper pins with the mating base holes, the loose filler hopper can be secured into position for proper delivery of tobacco filler 27 from within that hopper to the garniture 18.

In an embodiment, the loose filler hopper can include a semi-circular trough, or receptacle, in the bottom of the hopper into which a predetermined amount of tobacco filler 27 can be disposed. The tobacco filler 27 can be disposed in the hopper trough receptacle by gravity so as to arrange the loose filler 27 into a charge of tobacco 27, which can be rod-shaped. Alternatively, the loose tobacco filler 27 can be arranged into a charge of tobacco 27 in the receptacle by a suitable compression mechanism (not shown) attached to the loose filler hopper. Preferably, the receptacle is sized to contain a predetermined amount of tobacco filler 27 equivalent to the amount of tobacco filler 27 needed to make a cigarette rod of a particular length. For example, the receptacle can be sized to contain a sufficient amount of tobacco 27 to make a length of cigarette rod for cutting into 20 cigarettes 11. The size and shape of the receptacle, and the ability of the other components of the apparatus 10 to supply tobacco filler 27 to the receptacle, can be such that the receptacle can be readily filled with tobacco filler 27 in a complete, uniform, and reproducible manner. It is desirable to have sufficient tobacco filler 27 in the loose filler hopper above the receptacle to ensure supply of an adequate amount of tobacco filler 27 for a desired length of tobacco charge so as to provide for consistent supply of tobacco filler 27 to the wrapping paper 12 in the garniture 18. In operation, loose tobacco filler material 27 is placed in the loose filler hopper. The means 16 to deliver tobacco 27 to the garniture 18 can be utilized to move through the semi-circular receptacle in the bottom of the hopper to deliver the tobacco filler 27 in the receptacle from the hopper and onto the wrapping paper 12 in the garniture 18.

The tobacco filler 27 can be any type or blend. The tobacco filler 27 can have the form of cut filler 27 of a desirable particle size. Preferably, the tobacco filler 27 is substantially absent of tobacco dust or fines (extremely fine cut tobacco filler particles). When the loose tobacco filler 27 is handled and used to manufacture cigarettes 11 in accordance with the present invention, it is preferable that the various pieces of tobacco material that make up that tobacco filler 27 undergo an extremely low degree of breakage or degradation. Accordingly, embodiments of the cigarette-making apparatus 10 may be operated so as to cause an extremely low degree of degradation of the tobacco filler 27. The tobacco filler 27 can be made to specification, whether in the form of loose tobacco filler 27 or in a tobacco cartridge 13. The quality control (for example, as relates to amount of fines and control of breakage) of tobacco filler 27 can be facilitated and enhanced by the use of a tobacco cartridge 13 for delivering the tobacco filler 27 to the garniture 18. Therefore, embodiments in which a tobacco cartridge 13 is utilized are preferable.

In another aspect, the present invention includes a means to deliver tobacco filler 27 to the garniture 18. For example, the means to deliver tobacco filler 27 to the garniture 18 can be a tobacco filler delivery mechanism 16, which can be supported by the base 14 at the proximal end 25 of the cigarette manufacturing apparatus 10. The tobacco filler delivery mechanism 16 can be in the form of a solid rod or plunger configured to move the charge of tobacco filler 27 into position in the garniture 18. For example, the tobacco filler delivery mechanism 16 can be the length of the tobacco filler cartridge 13 and slidably connected to the base 14 in alignment with the tobacco cartridge 13 in the bottom of the tobacco filler cartridge hopper 17. When an operator moves the tobacco filler delivery mechanism 16 forward in the distal 26 direction, it pushes a charge of tobacco filler 27 in the form of a tobacco cartridge 13 from the hopper 17 onto the wrapping paper 12 in the garniture 18.

In the illustrated embodiment in FIG. 1, the tobacco filler delivery mechanism 16 is designed to deliver one tobacco filler cartridge 13 onto the garniture 18 at a time. In alternative embodiments, the tobacco filler insertion mechanism 16 may include any appropriate means for simultaneously transferring a plurality of tobacco cartridges 13 onto a corresponding plurality of garnitures 18.

The tobacco filler 27 can be delivered onto the wrapping paper 12 in the garniture 18 by alternative means in other configurations of the cigarette manufacturing apparatus 10. For example, in one embodiment (not shown), the loose tobacco filler hopper can be configured to be positioned above the garniture 18. That hopper can include a bottom having a slidable wall that can be slid sideways to allow a charge of tobacco filler 27 in the hopper receptacle to drop into position on a predetermined length of wrapping paper 12 in the garniture 18.

Embodiments of the present invention include a garniture 18 in which wrapping paper 12 is wrapped about the charge of tobacco filler 27. The wrapping paper 12 can be pulled from the bobbin 22 onto the upper surface of the garniture 18. As shown in the embodiment in FIG. 1, the wrapping paper 12 can be pulled through a paper opening 24 in the proximal end 25 of the garniture 18 to the distal end 26 of the garniture 18 into position to receive a charge of tobacco filler 27. The wrapping paper 12 may be pulled onto the garniture 18 upper surface by an appropriate paper unloading means 30. For example, the paper unloading means 30 can be a crank wheel attached underneath the base 14 at the distal end 26 of the garniture 18 by which the wrapping paper 12 is pulled into position. Once a predetermined length of the wrapping paper 12 is pulled into proper position in the garniture 18, the trailing edge of the paper 12 can be cut from the paper 12 supply on the bobbin 22. In another embodiment, the wrapping paper 12 can be left intact with the continuous supply of paper 12 from the bobbin 22 until the cigarette rod formed in the garniture 18 is moved to the cutting device 19. As the cigarette rod is moved forward into the cutting device 19, another predetermined length of wrapping paper 12 is pulled behind the formed cigarette rod into position in the garniture 18. Then, the trailing edge of paper 12 from the cigarette rod can be cut by the cutting device 19 to provide the leading edge of the next predetermined length of paper 12 for formation of a subsequent cigarette rod. In an preferred embodiment, the wrapping paper 12 is maintained in a stationary position in the garniture 18 relative to other components of the cigarette manufacturing apparatus 10 while it is wrapped about the charge of tobacco filler 27. Appropriate means for moving wrapping paper 12 into a desired position on the garniture 18 and for holding the wrapping paper 12 in that desired position for wrapping about the tobacco charge will be readily apparent to those skilled in the art of cigarette design and manufacture.

In another embodiment, the garniture 18 can include an endless, movable garniture belt (not shown) that can be actuated to move and deactuated to stop movement. The wrapping paper 12 can be routed from the bobbin 22 onto the upper surface of the garniture belt. As the garniture belt rotates, the wrapping paper 12, connected to the garniture belt, is moved into the desired position in the garniture 18 for receiving the charge of tobacco filler 27.

The garniture belt can be rotated by a garniture belt drive system (not shown), which can include a plurality of drive rollers rotatably attached to the bobbin support frame 20. A corresponding number of idler rollers are rotatably attached to the bobbin support frame 20 adjacent the drive rollers. The garniture belt is routed in serpentine fashion about the series of drive rollers and idler rollers, and is routed through a garniture belt opening in the base of the garniture 18. A motor (not shown) can be attached to the opposite side of the bobbin support frame 20 from the garniture belt. The motor is operably attached to at least one of the garniture belt drive rollers to power the drive roller. The garniture belt drive system is configured so that actuation of the motor causes movement of the garniture belt. The motor can be an electrical motor. The motor can include a variable speed control mechanism for moving the garniture belt at different desired speeds. In an alternative embodiment, the garniture belt can be operated manually with a rotary handle (not shown) engaged with the garniture belt.

In preferred embodiments, the cigarette rod forming process can be initiated for forming a single, finite length cigarette rod and stopped when that rod is formed. That is, the finite length of wrapping paper 12 delivered to the garniture 18 is maintained in a stationary position relative to other components of the cigarette manufacturing apparatus 10 while the cigarette rod is being formed. The cigarette rod may be sealed while maintained in a stationary position in the garniture 18, or the wrapping paper 12 and tobacco filler 27 may be moved in the garniture 18 for sealing the paper 12 onto itself. Once the cigarette rod is completely formed in the garniture 18, the cigarette rod can then be moved to the cutting device 19 for the next step of cutting the cigarette rod into individual cigarettes 11.

In an embodiment of a garniture 18, the wrapping paper 12 moved into the desired position in the garniture 18 remains stationary during the delivery of a charge of tobacco filler 27 onto the paper 12. To facilitate the secure positioning of the wrapping paper 12 in the garniture 18, the paper 12 can be held downward onto the upper surface of the garniture 18 base in an appropriate manner. For example, the paper 12 can be held downward onto the garniture 18 with a guide system (not shown). Such a guide system may include a series of rollers or arms attached to the garniture 18 positioned so as to exert downward pressure on the wrapping paper 12 in the garniture 18 and thereby hold the paper 12 in the desired position.

In another embodiment (not shown), the garniture 18 base may comprise a foraminous, or perforated, region, through which an air vacuum can apply negative air pressure to the wrapping paper 12 to hold the paper 12 downward in position against the garniture 18 base. The porous region of the garniture 18 can be adapted so as to be in communication with a suction (for example, as can be provided by appropriate connection to a vacuum source, such as a laboratory vacuum source). In addition to pulling the wrapping paper 12 downward, the negative air pressure applied to the bottom region of the garniture 18 can act to pull the tobacco filler material 27 downward, and hence facilitate to hold the desired amount of tobacco filler 27 in place on the wrapping paper 12 while the paper 12 is being wrapped about the tobacco filler 27. Suction can be provided to the wrapping paper 12 and tobacco filler 27 in the garniture 18, as well as to the formed cigarette rod after it is moved onto the cutting device platform 52. Applying suction to the cigarette rod on the cutting device platform 52 helps facilitate holding the cigarette rod in place for accurate cutting of the rod.

Once a length of the wrapping paper 12 is moved from the bobbin 22 to the desired position in the garniture 18, the charge of tobacco filler 27 is then delivered onto the wrapping paper 12. For example, as shown in the embodiment in FIG. 1, a tobacco filler cartridge 13 can be moved by the tobacco filler delivery mechanism 16 onto the wrapping paper 12 positioned in the garniture 13. The wrapping paper 12 is then wrapped about the tobacco filler cartridge 13.

The garniture 18 can be suitably configured or modified for the tobacco filler 27 to be delivered to the wrapping paper 12 and wrapped in the wrapping paper 12 in alternative manners. For example, the garniture 18 can include an apron rolling mechanism (not shown) similar to those utilized in commercially available hand-held, single cigarette rolling devices. In such an embodiment, a pair of rollers each having a length at least the length of a cigarette rod to be formed can be arranged in side-by-side fashion along the longitudinal axis of the garniture 18. The pair of apron rollers can be configured so that the outer surfaces of the rollers are movable into and out of contact with each other. When the apron rollers are moved out of contact with each other, a space between the rollers is created for receiving a supply of the tobacco filler 27 between the rollers. An apron of solid material is in contact with the bottom of each of the rollers so as to form a means for receiving the tobacco filler 27 and maintaining the tobacco filler 27 in a cylindrical, or rod-shaped, form between and in contact with the outer surfaces of the two rollers. The tobacco filler 27 can be delivered into the roller receiving space by any suitable means. For example, loose tobacco filler 27 can be sprinkled into the roller receiving space. In an alternative embodiment, a tobacco filler cartridge 13 can be inserted into the space by the tobacco filler delivery mechanism 16 described in relation to FIG. 1.

Once the tobacco filler 27 is placed in the receiving space between the rollers and onto the apron, the rollers can be moved into contact with each other and rolled. The rollers are preferably arranged so that when the rollers are rolled, one roller rolls in a clockwise direction and the other roller rolls in a counter-clockwise direction. In an embodiment in which the tobacco filler 27 delivered into the receiving space between the two rollers is in a loose form, rolling of the rollers causes the tobacco 27 to be formed together into a rod of tobacco filler 27. While the rollers are still in contact with each other, a length of the wrapping paper 12 sufficient to wrap about the length of the thusly formed rod of tobacco filler can be inserted into the nip between the two rollers. In one embodiment, the wrapping paper 12 can include an amount of pre-applied adhesive along one side of the length of the paper. The adhesive may be a self-adhering adhesive. When the wrapping paper 12 is in contact with the rollers, the rollers can be rolled so that the paper 12 is wrapped about the rod of tobacco filler 27. In this manner, a self-adhering adhesive will seal the edges of the wrapping paper 12 along the length of the rod of tobacco filler 27 to form a cigarette rod.

Figure 2:
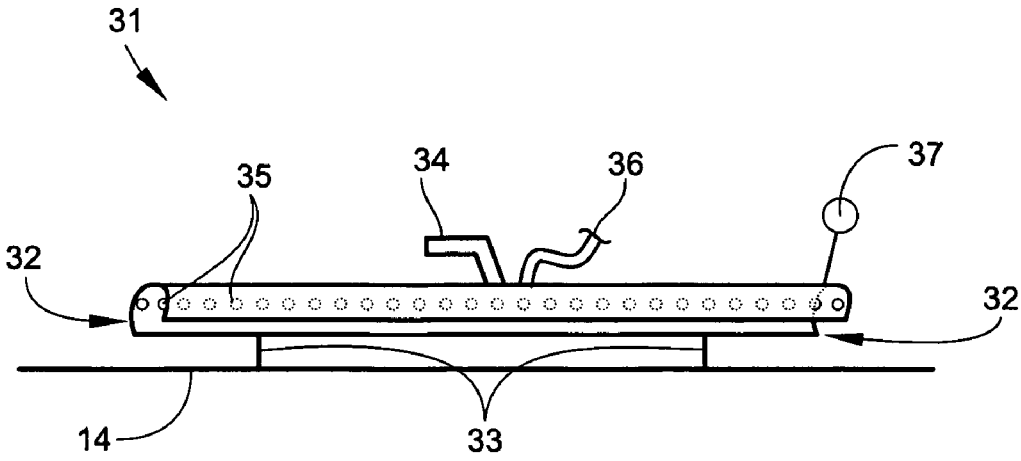
FIG. 2 is a diagrammatic view of the cigarette rod forming mechanism shown in FIG. 1 in an embodiment of the present invention.

The garniture 18 includes a means 31 for forming the wrapping paper 12 about the charge of tobacco filler 27. Appropriate means for forming the wrapping paper 12 about the tobacco filler charge into a tubular cigarette rod will be readily apparent to those skilled in the art of cigarette design and manufacture. In the embodiment shown in FIGS. 1 and 2, the forming mechanism 31 comprises a semi-tubular sleeve. The forming mechanism 31 can be manufactured from any suitable material and preferably is manufactured from a metallic material, such as stainless steel. The sleeve comprises an opening 32 at both ends and lengthwise along the bottom side of the sleeve. The forming mechanism sleeve 31 can be hingedly attached to the garniture 18 base so that the sleeve 31 can be rotated downward to engage the wrapping paper 12 and tobacco filler charge. The sleeve 31 can be slidable along the garniture 18. The leading edge of the forming sleeve 31 can be configured to facilitate formation of the paper 12 about the tobacco filler 27 in a tubular fashion and fold the wrapping paper 12 onto itself. Once the forming sleeve 31 is rotated downward and engages the wrapping paper 12 and tobacco filler charge and is slid forward toward the distal end 26 of the garniture 18, the wrapping paper 12 is folded into a tube about the tobacco filler charge to form a cigarette rod. In this operation, the forming mechanism 31 moves forward in the direction of the distal end 26 while the wrapping paper 12 and tobacco filler charge remain substantially stationery.

Movement of the forming mechanism 31 may be accomplished by an operator using a handle 34 that extends above the forming mechanism 31. The handle 34 may be connected to the forming mechanism 31 by means of screws or bolts combined with spacers, rivets, or by means of any other suitable connection mechanism. Using the handle 34, an operator can rotate the forming mechanism sleeve 31 downward to engage the wrapping paper 12 and tobacco filler charge (such as the tobacco filler cartridge 13), as well as move the sleeve 31 forward to wrap the paper 12 about the cartridge 13.

Once the wrapping paper 12 is wrapped and sealed about the tobacco rod, the forming mechanism sleeve 31 can be moved back into its original position. The cigarette rod thusly formed is allowed to rest on the upper surface of the garniture 18.

Forming the wrapping paper 12 about the tobacco filler charge creates one long rod from which a plurality of cigarettes 11 can be formed. The length of the cigarette rod depends on the desired length of individual cigarettes 11 and the number of cigarettes 11 to be formed from the cigarette rod. For example, the desired length of individual cigarettes 11 may be 35-75 mm, preferably 55-70 mm, (without a mouth end piece such as a filter added to the cigarette). A package of cigarettes 11 typically comprises 20 cigarettes 11. Making a lot of 20 cigarettes 11 at one time is desirable to provide an entire package of cigarettes 11. As an example, the length of a cigarette rod for making 20 individual cigarettes 11 of such lengths is between 70 cm and 150 cm (approximately ¾-1.5 meters). One preferred cigarette 11 length without a filter is 57 mm, and a cigarette rod for making 20 cigarettes 11 each having a length of 57 mm is approximately 114 cm in length. The actual length of the cigarette rod may be slightly longer than the cumulative end-to-end length of the number of cigarettes 11 to be made. This allows for excess amounts of the cigarette rod to be trimmed off each end of the long cigarette rod. Preferably, the amount of any excess trimmed from the cigarette rod is kept to a minimum so as to produce each of the plurality of cigarettes 11 from the rod having essentially the same size, shape, and appearance.

The garniture 18 can include a means for sealing the wrapping paper 12 onto itself. In an embodiment of the present invention, a line of adhesive can be applied along a seam of the wrapping paper 12 while the paper 12 is being wrapped about the charge of tobacco filler 27. For example, as shown in the embodiment in FIG. 2, the forming mechanism sleeve 31 can include one or more adhesive inlet ports 35 along one side of the forming sleeve 31. The adhesive inlet ports 35 are connected to an adhesive supply source 36. As the forming mechanism sleeve 31 is moved forward, an adhesive is applied through the inlet ports 35 to the overlapping seam of the paper 12 to seal the paper 12 into a tubular rod. Alternatively, the adhesive can be applied after the wrapping paper 12 is pulled from the bobbin 22 and before the paper 12 is positioned in place in the garniture 18, or after the paper 12 is in position in the garniture 18 and before the tobacco 27 is delivered onto the paper 12, and before the forming mechanism sleeve 31 is moved to wrap the paper 12 around the tobacco filler 27. In this alternative embodiment, suitably formulated hot glue can be applied to the wrapping paper 12 as it is moved into the garniture 18 or after it is positioned in the garniture 18. A suitably modified chill bar (not shown) can be positioned in the distal aspect of the garniture 18 so that when the cigarette rod is transferred to the cutting device 19, the hot glue is chilled to an appropriate degree for sealing the wrapping paper 12 together.

In another embodiment, the wrapping paper 12 wound around the bobbin 22 can have adhesive pre-applied such that the paper 12 does not stick to itself. For example, the pre-applied adhesive can be pressure-sensitive so that when pressure is applied to the paper 12 in the garniture 18, for example, by movement of the forming mechanism 31, the paper 12 seals to itself. In an alternative embodiment, the pre-applied adhesive can be activated by moisture. In this embodiment, the pre-applied adhesive can be moistened in the garniture 18 such that the contacting edges of the wrapping paper 12 will be sealed when contacted together. Other manners and methods for sealing the wrapping paper 12 about the charge of tobacco filler 27 will be apparent to those of skill in the art of cigarette design and manufacture. See also, Johnson, Development of Cigarette Components to Meet Industry Needs, 52$^{nd}$ *JSRC* (1998), which is incorporated herein by reference.

In an embodiment of the present invention, the wrapping paper 12 can include an additive material in addition to an adhesive for sealing the paper 12 to itself. For example, burn control additives (not shown) can be added to the paper 12 for forming low ignition propensity cigarettes 11. The burn control additive can be applied in bands placed at predetermined locations about the circumference of the wrapping paper 12. The bands can be placed a spaced-apart locations aligned transversely to the longitudinal axis of the paper 12. The burn control material can be applied prior to the paper 12 being placed on the bobbin 22. Alternatively, the burn control material can be applied to the wrapping paper 12 after it unwound from the bobbin 22 and before the charge of tobacco filler 27 is delivered to the paper 12 in the garniture 18. Various manners and methods of applying burn control additives to wrapping paper 18 will be apparent to those of skill in the art of cigarette design and manufacture.

Once formed, the cigarette rod can be moved forward from the garniture 18 into the cutting device 19 and cut into individual cigarettes 11. In an embodiment, the cigarette rod can be moved into the cutting device 19 directly from the garniture 18 by the tobacco filler delivery mechanism 16. The tobacco filler delivery mechanism 16 can be slidingly attached to one side of the base 14. The base 14 can include a groove that extends from the proximal end 25 of the base 14 where the tobacco filler delivery mechanism 16 is originally positioned to the distal end 26 of the garniture. The tobacco filler delivery mechanism 16 can thus slide from its original position to the distal end 26 of the garniture 18. In this manner, the tobacco filler delivery mechanism 16 can move the formed cigarette rod having a finite length from the garniture 18 into the cutting device 19. The tobacco filler delivery mechanism 16 may include a means for locking it in place adjacent the cutting device 19. In this way, when the leading end of the tobacco filler delivery mechanism 16 is positioned in contact with the trailing end of the cigarette rod and adjacent the cutting device 19, the delivery mechanism 16 can serve to hold the cigarette rod in place for cutting in the cutting device 19.

In another embodiment, the cigarette rod can be moved into the cutting device 19 directly from the garniture 18 by the forming mechanism 31. In such an embodiment, once the forming mechanism 31 has been moved longitudinally along the garniture 18 to form the wrapping paper 12 about the tobacco cartridge 13, the forming mechanism 31 can be returned to its original position at the proximal end 25 of the garniture 18 behind the cigarette rod just formed. The forming mechanism 31 can include a means for enclosing the proximal end 25 of the forming mechanism 31. For example, an end cap 37 can be rotatably attached to the trailing end of the forming mechanism 31. The end cap 37 can be held in an "up" position while the forming mechanism 31 is used to form the wrapping paper 12 about the tobacco cartridge 13. Once the cigarette rod is formed, the end cap 37 can be rotated downward to enclose the proximal end 25 of the forming mechanism 31. The forming mechanism 31 can then again be moved forward in the garniture 18, such that the end cap 37 contacts the trailing end of the formed cigarette. In this manner, the forming mechanism 31 can move the formed cigarette rod from the garniture 18 into the cutting device 19. When the end cap 37 of the forming mechanism 31 is positioned in contact with the trailing end of the cigarette rod and adjacent the cutting device 19, the forming mechanism 31 can serve to hold the cigarette rod in place for cutting in the cutting device 19.

The cutting device 19 located adjacent the garniture 18 is positioned for cutting the finite length cigarette rod into a plurality of cigarettes 11 after the cigarette rod is formed in the garniture 18 and transferred to the cutting device 19. The cutting device 19 can cut the cigarette rod in a manner perpendicular to the longitudinal axis of the rod to form the desired plurality of cigarettes 11.

Figure 10:
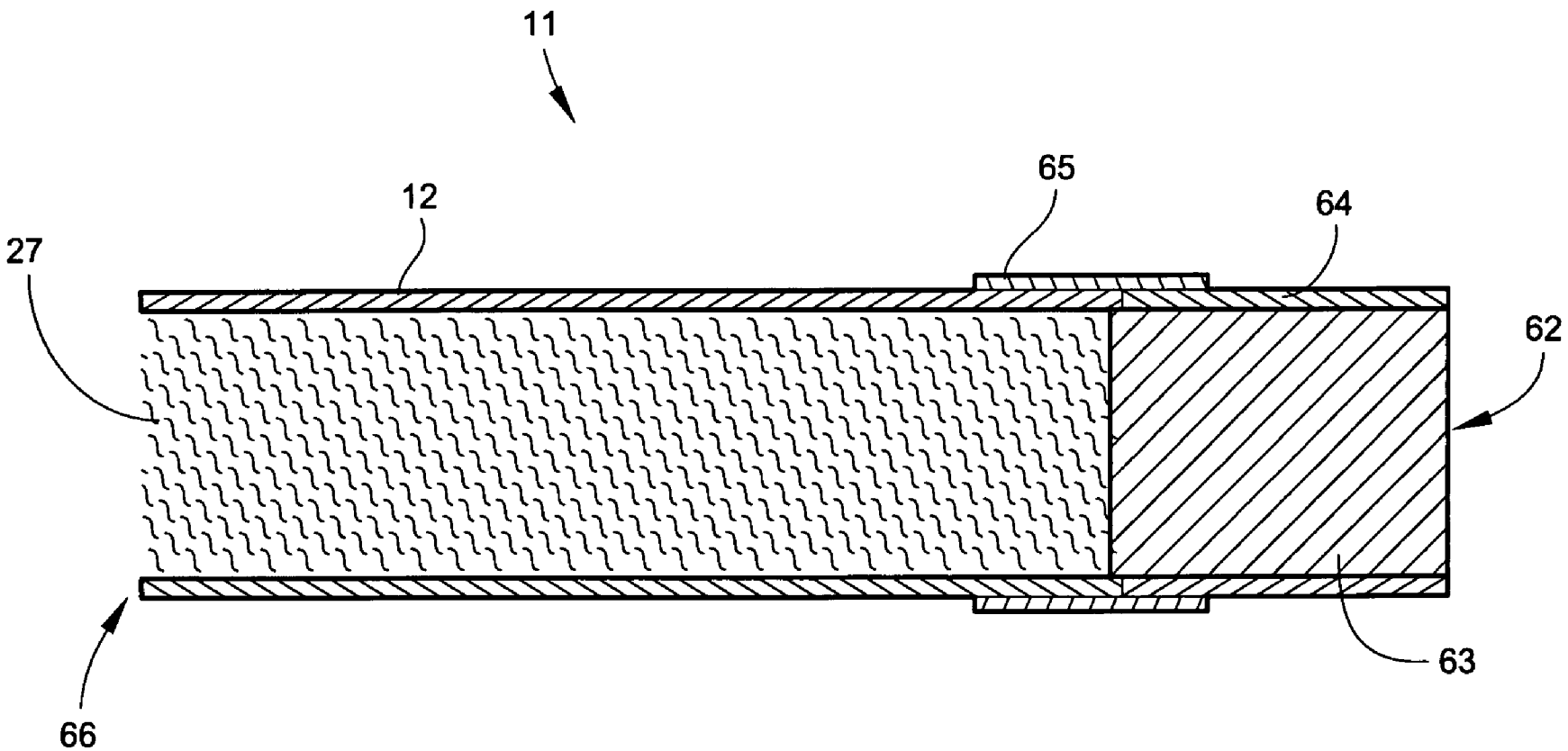
FIG. 10 is a cross-sectional view of a finished cigarette manufactured by embodiments of the present invention.

It is desirable that the ends of individual cigarettes 11 be substantially perpendicular to the longitudinal axis of the cigarette rod. A perpendicular end of the cigarette rod, and of cigarettes 11 subsequently formed therefrom, is desirable for various reasons, including geometrical alignment with filter elements 62 (as shown in FIG. 10) for attaching such elements 62, to provide a consistent length among cigarettes 11, and for aesthetic reasons. During formation of the cigarette rod in which the wrapper paper 12 is wrapped about the circumference of the charge of tobacco filler 27, each end of the cigarette rod may be formed such that it is other than perpendicular to the longitudinal axis of the rod. In an embodiment, the cutting device 19 can include a sufficient number of cutting blades 38 to cut the cigarette rod into a desired number of individual cigarettes 11 and to cut off the leading end and the trailing end of the cigarette rod. In this manner, a cigarette manufacturing apparatus 10 of the present invention can provide each of the cigarettes 111 cut from the cigarette rod with a perpendicular cut on each end.

Referring to FIG. 1, there is shown a cutting device 19 for cutting a cigarette rod formed in the garniture 18. The various components of the frame, or housing, of that device 19 preferably are manufactured from a metallic material, such as aluminum. Once a cigarette rod is formed in the garniture 18 and moved to the cutting device 19, the cigarette rod can be cut at predetermined locations into a plurality of individual cigarettes 11. The cutting device 19 can be of those types of cutting devices known in the art. In an embodiment, for example as shown in FIG. 1, the cutting device 19 can be attached to the base 14 at the distal end 26 of the garniture 18. The cutting device 19 can be attached to the base 14 with one or more hinges 39 such that the cutting device 19 can be moved downward to cut through the cigarette rod. A handle can be attached to an edge of the cutting device 19 to provide a means for safely manipulating the cutting device 19 downward across the cigarette rod. The cutting device 19 may be attached to the base 14 in other suitable fashions. For example, the cutting device 19 can be supported on a frame (not shown) mounted to the base 14 that supports the cutting device 19 slightly above the base 14 (similar in configuration to a radial arm saw). In this configuration, the cutting device 19 can be moved horizontally across the cigarette rod with the cutting blades 38 rotating completely through the cigarette rod and just above the upper surface of the base 14. A motor 40 may be attached to one end of the cutting device 19 to power rotation of the cutting blades 38.

As shown in the embodiment in FIG. 1, the cutting device 19 can include a plurality of circular cutting blades 38. The cutting blades 38 can be rotated to cut the rod at predetermined locations. The cutting device 19 can comprise a sufficient number of cutting blades 38 to cut the tobacco rod into a desirable number of cigarettes 11, for example, 20 cigarettes 11, upon a single pass of the blades 38. In this embodiment, the cutting device 19 can include 19 cutting blades 38 to provide 20 individual cigarettes 11 with a single pass of the cutting blades 38. Cigarettes 11 can be cut from the cigarette rod in various desired multiples of the total number of desired cigarettes 11. In another embodiment, the cutting device 19 can include a number of cutting blades 38 that is a multiple of the desired number of cigarettes 11 to be cut. In this way, cutting the cigarette rod into a desired number of individual cigarettes 11 may be accomplished with multiple passes of the cutting blades 38 through the cigarette rod. For example, with respect to a cigarette rod of an appropriate length for forming 20 cigarettes 11, the cutting device 19 can comprise ten cutting blades 38 which can cut the first half of the rod into a first set of ten individual cigarettes 11 with a single pass. After moving the cutting device 19 into position relative to the uncut second half of the cigarette rod, a second pass of the cutting device 19 can cut the second half of the rod into a second set often individual cigarettes 11. Alternatively, the cutting device 19 can comprise five cutting blades 38 which can be passed perpendicularly through each quarter of the cigarette rod to provide five cigarettes 11 from each pass.

In another embodiment, the cutting device 19 can include a sufficient number of cutting blades 38 to provide a desired number of individual cigarettes 11 from the cigarette rod and to trim off the leading and/or trailing end of the rod. For example, the cutting device 19 can include 21 cutting blades 38 in order to cut 20 cigarettes from a cigarette rod and to simultaneously trim the leading and trailing ends of the cigarette rod. In this way, a single pass of the cutting blades 38 can trim both ends of each of the 20 cigarettes produced.

Movement of the cutting blades 38, for example, rotation of the cutting blades 38, is preferably operated electronically. Movement of the cutting device 19 into position for cutting the cigarette rod into individual cigarettes 11 can be accomplished manually or electronically. Electronic operation of the cutting blades 38 and movement of the cutting device 19 into position can be actuated by a switch 41.

During an operation of the cutting device 19, the circular cutting blades 38 are rotated at a very high rate of speed (for example, 1200-2000 rpm) by the motor 40. The motor 40 can be started by activating the switch 41. The circular cutting blades 38 may be covered by a blade housing. The motor 40 also may be covered by an optional motor housing. A suitable motor 40 is an induction motor of at least the size of 25 W (1/30 HP), 115V P/N, 41K25A-AWU, available from Oriental Motor USA Corp. The motor 40 may need to have a larger capacity to operate a larger number of cutting blades 38, depending also, for example, on the size of the blades 38, gearing, speed of rotation, and motor efficiency. A representative cutting blade 38 may be constructed of tungsten carbide, and has a diameter of about 62 mm and a thickness of about 0.3 mm. The cutting device 19 can be moved downward from its "up" position and moved through the cigarette rod in a single downward motion. As a result, the cutting device 19 can cut the cigarette rod at desired predetermined locations to form a small lot of individual cigarettes 11. The type and design of motor, gears, cutting mechanism, and operation of a cutting device 19 useful in the present invention will be apparent to those of skill in the art of cigarette design and manufacture. For example, one motor useful in an embodiment of the present invention is described in co-pending U.S. patent application Ser. No. 11/281,083, filed Nov. 17, 2005, to Barnes et al., which is incorporated herein by reference.

In an alternative embodiment, the cutting device 19 can be mounted to the side and parallel to the longitudinal axis of the garniture 18 such that the cutting blades 38 cut the cigarette rod perpendicular to its longitudinal axis. The cutting device 19 can be positioned so as to pass through the cigarette rod at predetermined locations in order to cut the cigarette rod into individual cigarettes 11 of a desired length. Appropriate other cigarette rod cutting means will be readily apparent to those skilled in the art of cigarette design and manufacture.

Figure 4:
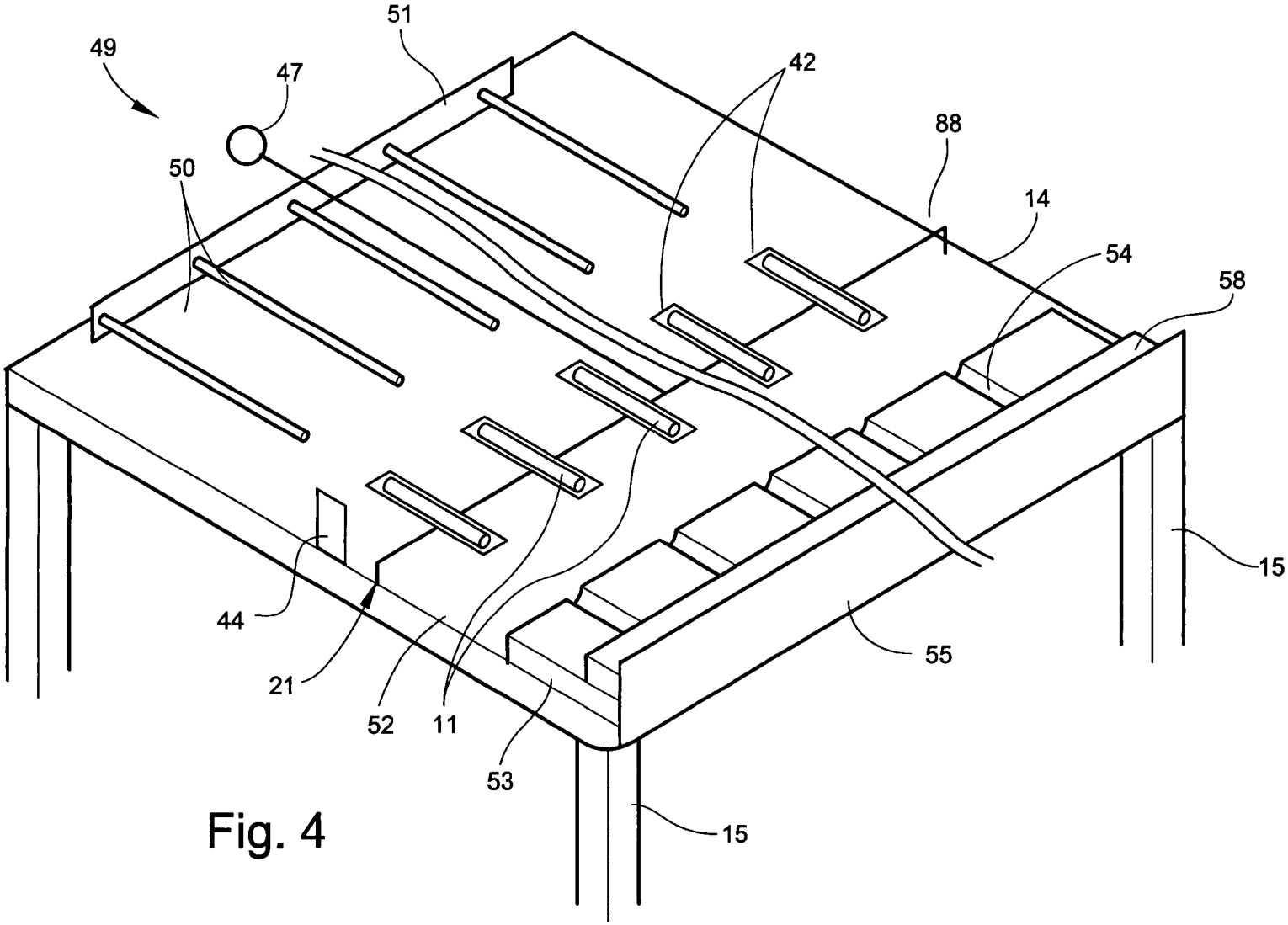
FIG. 4 is a diagrammatic, cut-away view of the means for orienting cigarettes shown in FIG. 1, showing the cutting device support members in rotated position, a set of cigarette ejection rods, and a cigarette tray for receiving the cigarettes moved from the cutting device support members by the ejection rods in an embodiment of the present invention.

In the embodiment shown in FIG. 1, the base 14 located below the cutting device 19 can be configured into a plurality of cutting device support members 42. As shown in FIG. 4, the support members 42 can be separate containers, or cradles, having a grooved upper surface 43. Each support member 42 can be sized to cradle an individual cigarette 11. In an embodiment, the cutting device support members 42 can be rotated to orient the plurality of cut cigarettes 11 in a different direction (discussed herein). The cutting blades 38 can be arranged such that the blades 38 pass through the cigarette rod at the ends of the cutting device support members 42. In this manner, a cigarette 11 having a desired length slightly less than the length of the cutting device support member 42 can be cut from the cigarette rod and contained within the cutting device support member 42.

An embodiment of a cigarette manufacturing apparatus 10 of the present invention can include a means for collecting and discarding debris that results from cutting the cigarette rod into individual cigarettes 11 and from trimming the ends of the rod. The cutting debris may be loose tobacco filler 27 and/or cut ends. For example, the cigarette manufacturing apparatus 10 can include a removable tray (not shown) located beneath the base 14 of the cutting device 19 that can collect tobacco particles and cigarette ends from the cutting process.

In use, once the cigarette rod formed in the garniture 18 is transferred to the cutting device 19, the leading end of the cigarette rod can be positioned against a cigarette rod stop 44. The cigarette rod stop 44 extends above the upper surface of the base 14 at its distal end 26. The cigarette rod stop 44 serves to stop movement of the cigarette rod as it is moved onto the cutting device platform 52 and to help hold the cigarette rod in the desired position while it is being cut.

Figure 3:
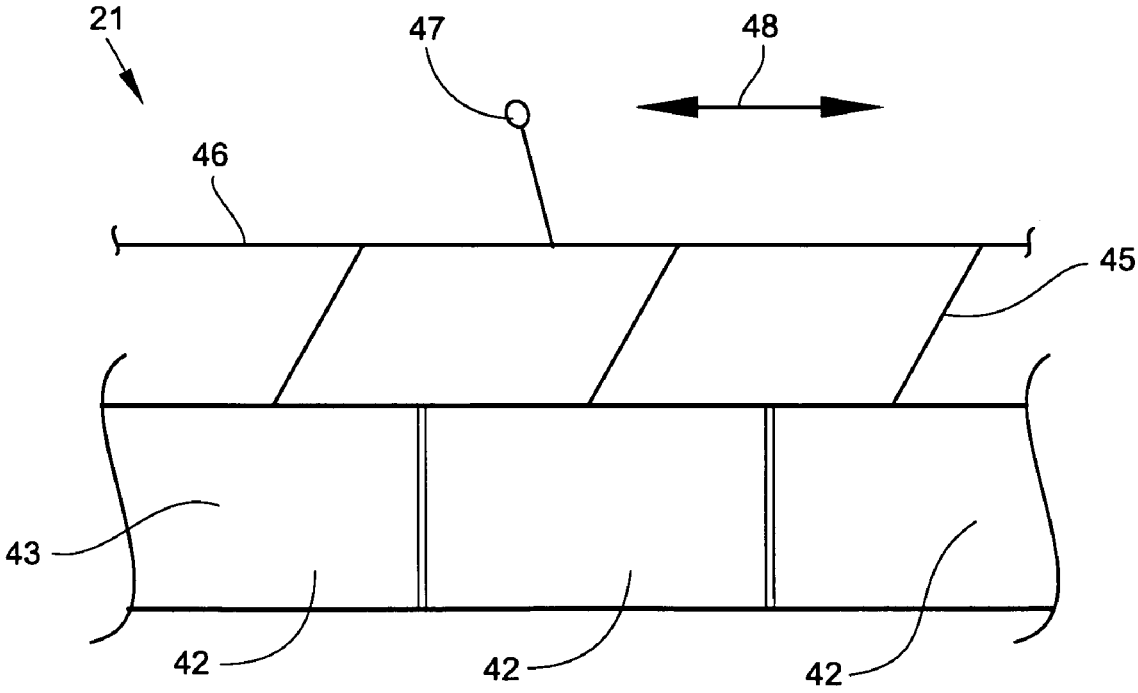
FIG. 3 is a diagrammatic view of the means for orienting cigarettes shown in FIG. 1, illustrating cutting device support members and a mechanism for rotating the cutting device cartridges in an embodiment of the present invention.

In another aspect, a cigarette making apparatus 10 of the present invention can include a means 21 for orienting the plurality of cigarettes 11 cut from the tobacco rod into side-by-side alignment for packaging. The means 21 for orienting cigarettes can be configured to rotate the cigarettes 11 a particular amount, for example, between 30 and 120 degrees from the longitudinal axis of the cigarette rod and the cutting device 19. In a preferred embodiment, the means 21 for orienting the cigarettes 11 can rotate the cigarettes 11 approximately 90 degrees from the longitudinal axis of the cigarette rod. In the exemplary embodiment shown in FIGS. 1, 3, and 4, the cutting device 19 can comprise a series of cutting device support members 42 along the cutting platform 52 of the device 19. Preferably, the cutting device 19 includes a cutting device support member 42 for each cigarette 11 to be cut by one pass of the cutting blades 38. The support members 42 are positioned relative to the cutting blades 38 such that when the cigarette rod is cut, each resulting cigarette rests in a separate support member 42. The support members 42 can be rotatably connected with a pivot arm 88 (for example, a ball bearing mechanism) to the upper surface of the base 14 below the support members 42. Preferably, the support members 42 are configured to rotate simultaneously about the pivot arm 88. For example, as shown in FIG. 3, each support member 42 can be connected with a support member connector arm 45 to a rotator rod 46 that is disposed in a horizontal plane just above the base 14 and in the same direction as the longitudinal axis of the cutting device 19 and the cigarette rod. The rotator rod 46 may include a handle 47 for moving the rotator rod 46. When the handle 47 and rotator rod 46 are moved in the direction 48 of the longitudinal axis of the cutting device 19 and the cigarette rod, each support member 42, and thus each cigarette 11 held within the support members 42, is rotated simultaneously. The support members 42 may include a mechanism for stopping rotation at a particular point, for example, when the support members 42 reach a point that is 90 degrees from the longitudinal axis of the cutting device 19 and the cigarette rod. In this manner, the cigarettes 11 cut from the cigarette rod can be oriented into alignment with each other to facilitate transfer for packaging.

A cigarette making apparatus 10 of the present invention may include other means 21 for orienting the plurality of cigarettes 11 cut from the tobacco rod. Appropriate other means 21 for orienting the plurality of cigarettes 11 will be readily apparent to those skilled in the art of cigarette design and manufacture.

In another aspect, a cigarette making apparatus 10 of the present invention can include a means 49 for moving the cigarettes 11 from the cutting device 19 to a tipping and/or packaging device. The means 49 for moving the cigarettes 11 from the cutting device 19 to another device for finishing the manufacture of a small quantity of cigarettes 11 can be in the form of a gravity feed mechanism, conveyor mechanism, tray that can be moved manually or automatically, and/or other suitable mechanism for transferring cigarettes 11 from one location to another during manufacture. In the embodiment shown in FIGS. 1 and 4, the apparatus 10 can include 20 generally cylindrical ejector rods 50 slidingly connected to the base 14 in the same plane and adjacent to the cutting device 14. The ejector rods 50 can be connected to a cross member 51, which can serve as a means for moving each of the ejector rods 50 simultaneously toward the cigarettes 11 in the cutting device 19. After the cigarettes 11 have been oriented substantially perpendicularly to the cutting device 19, the cross member 51 and the attached ejector rods 50 can be moved perpendicularly to the longitudinal axis of the cutting device platform 52 (upper surface of the base 14 in the cutting device 19) to move the ejector rods 50 into contact with the ends of the cigarettes 11 on the cutting device support members 42. The cigarettes 11 can thus be ejected from the cutting device support members 42 onto the cigarette tray 53.

Various other means for transferring the plurality of aligned cigarettes 11 to a tipping and/or packaging device will be readily apparent to those skilled in the art of cigarette design and manufacture. For example, the cigarettes 11 can be turned 90 degrees on a turning drum (as described below) and then collected such as by tilting the cutting device platform 52 and transferring the cigarettes 11 via a cigarette hopper to the tipping device. Alternatively, the formed and cut cigarettes 11 can be transferred to the tipping device by a conveyor mechanism. Preferably, each of the cigarettes 11 that has been cut from the cigarette rod can be moved to the cigarette tray 53 simultaneously. The cigarettes 11 are preferably moved to the hopper in a "no-touch" or "hands-free" manner.

As shown in FIGS. 1 and 4, the cigarettes 11 can be transferred from the cutting device 19 to the cigarette tray 53. The base 14 supports the movable cigarette tray 53, which can be manufactured from a suitable material as described herein for the base 14. Preferably, the cigarette tray 53 is manufactured from a metal, such as aluminum. Although the dimensions of the cigarette tray 53 can vary, and can be a matter of design choice, a representative, generally rectangular-shaped cigarette tray 53 is about 7 cm deep, about 26.5 cm long, and about 2.5 cm high.

Figures 5, 6:
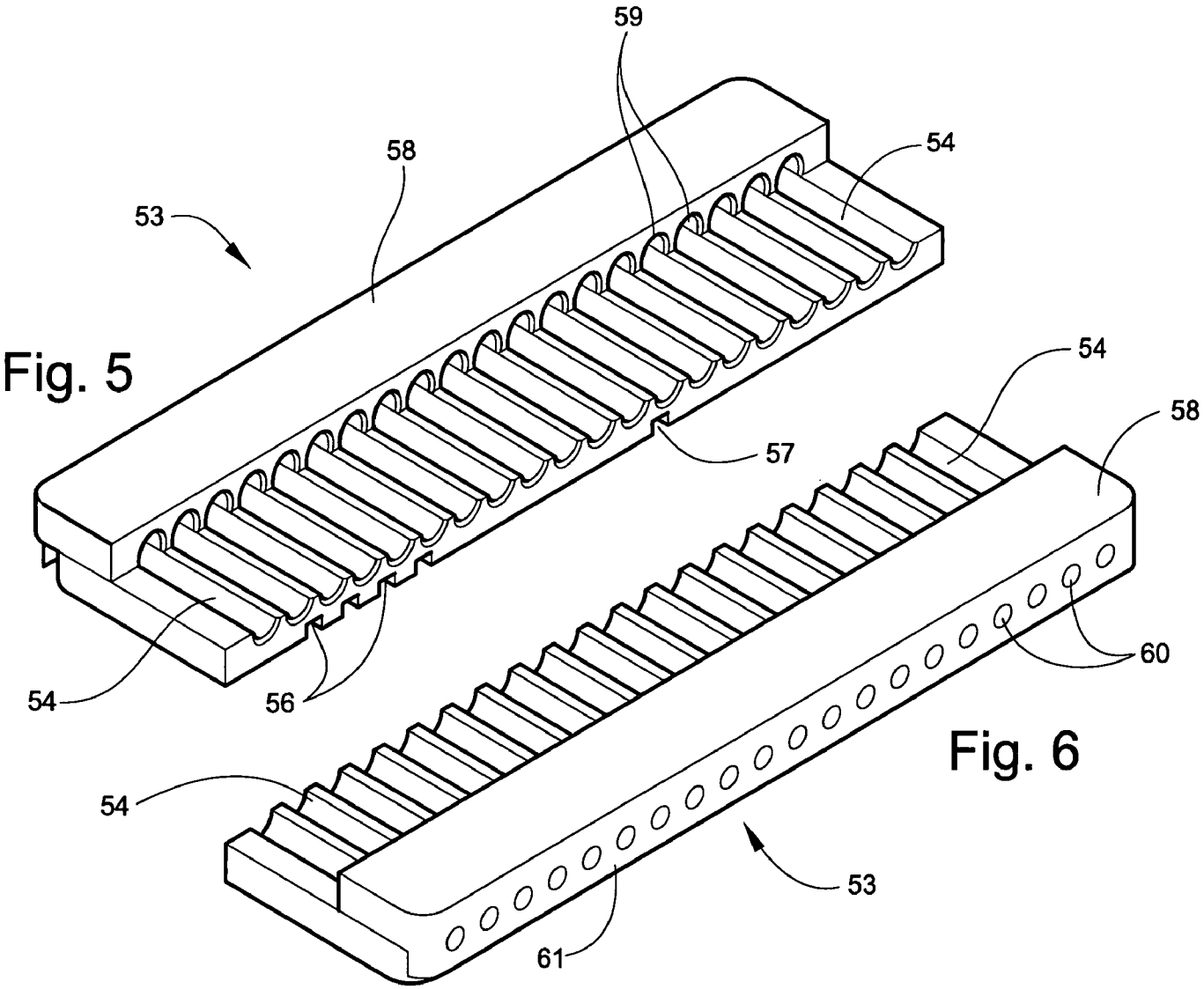
FIG. 5 is a rear perspective view of the cigarette tray shown in FIG. 4, in an embodiment of the present invention.
FIG. 6 is a front perspective view of the cigarette tray shown in FIG. 4, in an embodiment of the present invention.

Referring to FIGS. 4, 5, and 6, the cigarette tray 53 includes a series of parallel rounded grooves 54 in its upper face, with the grooves 54 being oriented perpendicular to the longitudinal axis of the tray 53. The size and shape of the grooves 54 can vary, and generally depend upon factors such as the size of a manufactured cigarette 11 that is properly positioned in each respective groove 54. That is, each groove 54 acts like a cradle for a manufactured cigarette 11. A representative groove 54 is designed to hold a cigarette 11 that is about 86 mm long with a circumference of about 24.5 mm. The representative groove 54 has a generally semi-circular shape of about 4.4 mm radius and is about 60 mm long. As such, each cigarette 11 can extend about 30 mm beyond the rear face of the cigarette tray 53. For the embodiment shown in FIGS. 5 and 6, the cigarette tray 53 includes 20 grooves, and thus the cigarette tray 53 can hold 20 manufactured cigarettes 11.

The cigarette tray 53 can be adapted to be removable from the base 14. Thus, a cigarette tray 53 loaded with cigarettes 11 cut from a cigarette rod formed from the wrapping paper 12 having been wrapped about tobacco filler 27 can be removed from the base as a holder of the cigarettes 11 for transferring the cigarettes 11 to a tipping device and/or a packaging device.

The cigarette tray 53 can be adapted to be capable of being maintained firmly in place relative to the base 14 during periods when finished cigarettes 11 are being off-loaded from the cutting device platform 52 to the cigarette tray 53. A cigarette tray retaining wall 55 can extend upward from the edge of the cutting device platform 52 for holding the tray 53 in position adjacent the cutting device support members 42.

Desired secure positioning of the removable cigarette tray 53 within the base 14 can be accomplished by any suitable means. For example, the cigarette tray 53 may be laterally secured to the base 14 using, for example, a pin or key type of design, for example, a key stock (not shown), whereby an upwardly extending protrusion located at a predetermined position in the base 14 cooperates with an alignment slot 56 located at a predetermined location in the bottom face of the cigarette tray 53. The key stock provides for a convenient manner of positioning of a cigarette tray 53 securely in a desired position relative to the base 14.

The key stock can be a longitudinal protrusion with a square cross-section that extends from the side of the cutting device platform 52 to the cigarette tray retaining wall 55. That is, the key stock is designed to align with each of a series of mating slots 56 located at pre-determined locations on the bottom face of the cigarette tray 53 (see FIG. 5). As such, there is provided a precise and desired alignment of a set of cigarettes 11 on the cutting device platform 52 with the grooves 54 in the cigarette tray 53. By aligning the upwardly extending key stock on the base 14 with the mating alignment slots 56 in the cigarette tray 53, the cigarette tray 53 can be secured into position for proper transfer of the cigarettes 11 from the cutting device support members 42 on the cutting device platform 52 to the tray 53. The cigarette tray 53 can include several alignment slots 56 located at predetermined locations on the tray 53 that can serve as a means for moving the tray 53 laterally along the base 14 adjacent the cutting device platform 52. In this manner, in embodiments in which the cutting device 19 cuts fewer cigarettes 11 at one time than the number of grooves 54 in the cigarette tray 53, the tray 53 can be moved laterally to align the empty grooves 54 in the tray 53 with the cigarettes 11 on the cutting device platform 52. For the embodiment shown in FIGS. 5 and 6, the cigarette tray 53 includes four mating alignment slots 56. With this configuration, a base 14 including a single upwardly extending, cooperating key stock allows for the secure alignment or registration of the cigarette tray 53 in at least four independent positions on the base 14 of the cigarette manufacturing apparatus 10. If a cigarette tray 53 comprises 20 grooves 54 and the cutting device 19 cuts five cigarettes 11 at a time from a cigarette rod, the cigarette tray 53 can be securely positioned adjacent the cutting device platform 52 by positioning a first alignment slot 56 in the tray 53 onto the upwardly extending key stock. A first set of five cigarettes 11 cut from the cigarette rod can be transferred from the cutting device platform 52 to a first set of five grooves 54 in the cigarette tray 53. The cigarette tray 53 can then be moved laterally and securely positioned adjacent the cutting device platform 52 by positioning a second alignment slot 56 in the tray 53 onto the upwardly extending key stock. In this manner, a second set of five grooves 54 in the cigarette tray 53 can be aligned with a second set of five cigarettes 11 cut from the cigarette rod, upon which the second set of cigarettes 11 can be transferred to the second set of grooves 54 in the tray 53. This sequence can be repeated until a desired multiple of five cigarettes 11 is transferred to the cigarette tray 53 and/or until each of the 20 grooves 54 in the cigarette tray 53 holds a cigarette 11.

In addition, as shown in FIGS. 5 and 6, a cigarette tray retaining wall 55, or other suitably designed tray retaining means, protruding upwardly across the length of one end of the cutting device platform 52, acts to hold the cigarette tray 53 (and cigarettes 11 carried thereby) in place relative to the base 14. Use of the cigarette tray retaining wall 55 and/or other securing means may thus minimize or prevent undesirable effects of movement (whether side-to-side or back-and-forth) during off-loading of the cigarettes 11 from the cutting device platform 52 to the cigarette tray 53.

The cigarette tray 53 may include at least one optional coordinating slot 57 on its bottom face at a predetermined location that is a distance apart from the location of the alignment slots 56. The coordinating slot 57 can be used to provide for a desired positioning of the cigarette tray 53 within one or more other devices, such as, for example, an apparatus designed to transfer cigarettes from the tray 53 to a container. A representative device for transferring cigarettes from the cigarette tray 53 to a container for consumer packaging is described below with reference to FIGS. 7, 8, and 9.

The cigarette tray 53 includes a raised region 58 on the front thereof. The raised region 58 facilitates capture and control of one end of the cigarettes 11 within a series of preferably semi-cylindrical grooves, or cavities 59, on the cigarette tray 53. In this way, desired positioning of the cigarettes 11 on the cigarette tray 53 is promoted.

Referring to FIG. 6, there is shown a front view of the cigarette tray 53. A series of cylindrical push-through openings 60 is aligned across the front face 61 of the cigarette tray 53. Each opening 60 extends through the raised front region 58 of the cigarette tray 53 to a corresponding cavity 59, and is aligned with a corresponding groove 54. In a representative embodiment, for a cigarette tray 53 adapted to contain cigarettes 11 having circumferences of about 7 mm to about 8.5 mm, the passageway 60 has a diameter of about 5 mm. That is, each push-through opening 60 is not so large as to allow a cigarette 11 to pass therethrough. The openings 60 allow for cigarettes 11 positioned on the cigarette tray 53 to be removed from the tray 53 by inserting appropriately sized rods into the openings 60 so as to push the cigarettes 11 from the tray 53. A device for facilitating this operation is described below with reference to FIGS. 7, 8, and 9.

In operation, a cigarette tray 53 is placed on the base 14 adjacent the cutting device platform 52. Alignment of the grooves 54 in the tray 53 with the cutting device cigarette support members 42 is facilitated by fitting the mating alignment slot 56 located on the bottom face of the cigarette tray 53 with the key stock protruding from the upper face of the base 14. The cutting device cigarette support members 42 are turned to move the cigarettes 11 substantially perpendicularly from the longitudinal axis of the cutting device 19 so as to orient the cigarettes 11 for transferring to the cigarette tray 53. The cigarette ejector rods 50 are moved toward the cigarettes 11 on the cutting device cigarette support members 42 and used to push the cigarettes 11 onto the grooves 54 of the cigarette tray 53. Preferably, movement of the cigarette ejector rods 50 is performed manually by the operator. As such, a predetermined number of cigarettes 11 are provided on the cigarette tray 53. This completes a single manufacturing operation cycle for one lot of cigarettes 11 (for example, five, ten, or twenty cigarettes).

Embodiments of a cigarette 11 provided by a cigarette making apparatus 10 of the present invention can include a mouth piece at one end of the cigarette 11. Alternatively, a cigarette 11 provided by the cigarette making apparatus 10 may be assembled without a mouth piece. In embodiments of a cigarette 11 having a mouth end piece, the mouth end piece can vary. Preferred mouth end pieces have the form of filter elements 62, as shown in FIG. 10. The selection of a particular filter element 62, including, or in addition to, a desired degree of air dilution, will be readily apparent to those skilled in the art of cigarette design and manufacture. Properties such as the composition and size of the filter element 62, and the format and configuration of the filter element 62, can be a matter of design choice. Representative filter materials 63 can be manufactured from tow materials (for example, cellulose acetate or polypropylene tow) or gathered web materials (for example, gathered webs of paper, reconstituted tobacco, cellulose acetate, polypropylene, or polyester). Preferred filter elements 62 are composed of plasticized cellulose acetate tow. Certain filter elements 62 can have relatively high efficiencies for removing selected gas phase components of the mainstream aerosol. Filter elements 62 can be segmented in nature. Filter elements 62 can incorporate flavors, flavored pellets, breakable capsules, resin particles, activated carbon particles, and the like. The filter elements 62 can be of a one segment or multi-segment design. An representative filter element 62 has a length of 20 mm to about 40 mm, preferably about 25-35 mm, and most preferably about 25-30 mm.

Representative filter element 62 components, designs, and assemblies are described in Browne, The Design of Cigarettes, 3rd Ed. (1990); Tobacco Production, Chemistry and Technology, Davis et al. (Eds.) 1999; U.S. Pat. Nos. 2,881,770 to Touey; 3,101,723 to Seligman et al.; 3,217,715 to Berger et al.; 3,236,244 to Irby et al.; 3,347,247 to Lloyd; 3,370,595 to Davis et al.; 3,648,711 to Berger et al.; 3,957,563 to Sexstone; 3,972,335 to Tigglebeck et al.; 4,174,720 to Hall; 4,201,234 to Neukomm; 4,223,597 to Lebert; 4,508,525 to Berger; 4,807,809 to Pryor et al.; 4,903,714 to Barnes et al.; 4,920,990 to Lawrence et al.; 5,012,829 to Thesing et al.; 5,025,814 to Raker; 5,074,320 to Jones, Jr. et al.; 5,076,295 to Saintsing et al.; 5,101,839 to Jakob et al.; 5,105,834 to Saintsing et al.; 5,105,838 to White et al.; 5,137,034 to Perfetti et al.; 5,271,419 to Arzonico et al.; 5,360,023 to Blakley et al; 5,396,909 to Gentry et al.; 5,360,023 to Blakley et al.; 5,568,819 to Gentry et al.; 5,622,190 to Arterbery et al.; 5,718,250 to Banerjee et al.; 6,530,377 to Lesser et al.; 6,537,186 to Veluz; 6,584,979 to Xue et al.; 6,595,218 to Koller et al.; 6,615,842 to Cerami et al.; and 6,631,722 to MacAdam et al.; 6,656,412 to Ercelebi et al.; 6,761,174 to Jupe et al.; 6,779,528 to Xue et al.; 6,789,547 to Paine III; 6,805,174 to Smith et al.; 6,814,786 to Zhuang et al.; 6,848,450 to Lilly, Jr. et al.; 6,907,885 to Xue et al.; and 6,913,784 to Xue et al.; U.S. Patent Application Pub. Nos. 2002/0014453 to Lilly, Jr. et al.; 2003/0154993 to Paine et al.; 2004/0107973 to Atwell; 2004/0194792 to Zhuang et al.; 2004/0226569 to Yang et al.; 2004/0237984 to Figlar et al.; 2005/0133051 to Luan et al.; 2005/0049128 to Buhl et al.; 2005/0066984 to Crooks et al.; 2005/0282693 to Garthaffner et al.; 2006/0025292 to Hicks et al.; 2004/0261807 to Dube et al.; 2005/0066983 to Clark et al.; 2005/0133051 to Luan et al.; 2005/0133052 to Fournier et al.; and 2006/0021624 to Gonterman et al.; European Pat. Application 579410 to White; PCT WO 02/37990 to Bereman; and U.S. patent application Ser. No. 11/226,932, filed Sep. 14, 2005, to Coleman et al.

The plug wrap 64 used to construct the mouth end piece can vary. Plug wrap papers 64 are available from Schweitzer-Mauduit International as Porowrap Plug Wrap 17-M1, 33-M1, 45-M1, 65-M9, 95-M9, 150-M4, 260-M4, and 260-M4T; and from Olsany Facility (OP Paprina) of the Czech Republic (Trierenberg Holding) as Ref. No. 646.

The tipping material 65 used to construct the mouth end piece and attach the mouth end piece to the remainder of the smoking article can vary. Typical tipping materials 65 are papers exhibiting relatively high opacities. Typical tipping materials 65 also are treated with so-called "lip release" agents, such as nitrocellulose. Representative tipping papers 65 and overwrap materials that are used in accordance with the present invention typically have basis weights of about 25 g/m2 to about 60 g/m$^2$, and often of about 30 g/m$^2$ to about 40 g/m$^2$. Representative tipping papers 65 are available as Tervakoski Nos. 3124, TK 652, A362, and A360.

Cigarettes 11 manufactured in accordance with the present invention can be air diluted, or ventilated. The amount or degree of air dilution or ventilation can vary. Frequently, the amount of air dilution for an air diluted cigarette 11 is greater than about 10 percent, often is greater than about 20 percent, generally is greater than about 30 percent, and sometimes is greater than about 40 percent. Typically, the upper level for air dilution does not exceed about 80 percent, and often is less than about 70 percent. As used herein, the term "air dilution" is the ratio (expressed as a percentage) of the volume of air drawn through the air dilution means to the total volume of air and smoke drawn through the cigarette 11 and exiting the mouth end of the cigarette 11. One manner or method for providing air-diluted, filtered cigarettes 11 involves the use of pre-perforated tipping material 65. For example, the mouth end region of the cigarette 11 can be circumscribed by at least one ring of perforations through the tipping material 65, and a porous plug wrap 64 is employed in order to conveniently provide a means for introducing air dilution to the cigarette 11. A ring of air dilution perforations can extend around the cigarette 11 perpendicular to the longitudinal axis of that cigarette 11, and those perforations are positioned at least about 10 mm, frequently at least about 13 mm, and sometimes at least about 15 mm, from the extreme mouth end of the cigarette. See, also, for example, U.S. Pat. App. Nos. 2005/0066980 to Crooks et al. and 2005/0103355 to Holmes.

In an embodiment of the present invention, the cigarettes 11 cut from the cigarette rod can be transferred to a tipping device (not shown) for adding a mouth piece end, such as a filter element. In the tipping device, the cigarettes 11 can have a filter element tip 62 attached in various ways. For example, in an embodiment in which one cigarette 11 is made at a time, a filter element 62 can be aligned with the cigarette 11, and tipping material 65 can be employed to connect the filter element 62 and the cigarette 11 together. In an embodiment in which two cigarettes 11 are made at the same time, a filter element 62 can be aligned at each end of the cigarette rod having the length of two cigarettes 11, and tipping material 65 can be employed to connect the filter element 62 at each end to the cigarette rod. The two cigarette-length rod can then be sub-divided into two filtered cigarettes 11. Representative equipment for feeding (for example, trays, hoppers, wheels, and the like), aligning, tipping, or otherwise connecting, subdividing, turning, conveying, separating, and collecting (for example, using trays, belts, hoppers, and the like) components of cigarettes 11 using tipping devices will be apparent to those skilled in the art of cigarette design and manufacture. See, for example, the types of devices and combination techniques set forth in U.S. Pat. Nos. 3,308,600 to Erdmann et al.; 4,280,187 to Reuland et al.; 4,281,670 to Heitmann et al.; and 6,229,115 to Vos et al.; and U.S. Pat. Publication No. 2005/0194014 to Read, Jr. Representative tipping devices are available as MAX, MAX S or MAX 80 from Hauni Maschinenbau AG of Hamburg, Germany. In embodiments of the present invention, filter elements 62 can most preferably be connected to cigarette rods using equipment such as is available as Lab MAX from Hauni Maschinenbau AG and LKF-01 Laboratory Multi Filter Maker from Heinrich Burghart GmbH.

In a preferred embodiment, the lighting end 66 of the manufactured cigarette 11 preferably is configured such that the cut tobacco filler 27 (for example, the tobacco filler 27 in a tobacco cartridge 13) extends only to the end of the wrapping paper 12 in an assembled cigarette 11. In a preferred embodiment of the cigarette 11, the tobacco filler 27 abuts the filter element 62. Alternatively, the tobacco filler 27 may be separated from the filter element 62 by a space that is preferably less than 1 mm.

An embodiment of a cigarette making apparatus 10 of the present invention can include a means for packaging the plurality of cigarettes 11 cut from a cigarette rod. Once the aligned cigarettes 11 are positioned in alignment in the cigarette tray 53, the tray 53 can be transported to a packaging device.

Figure 7:
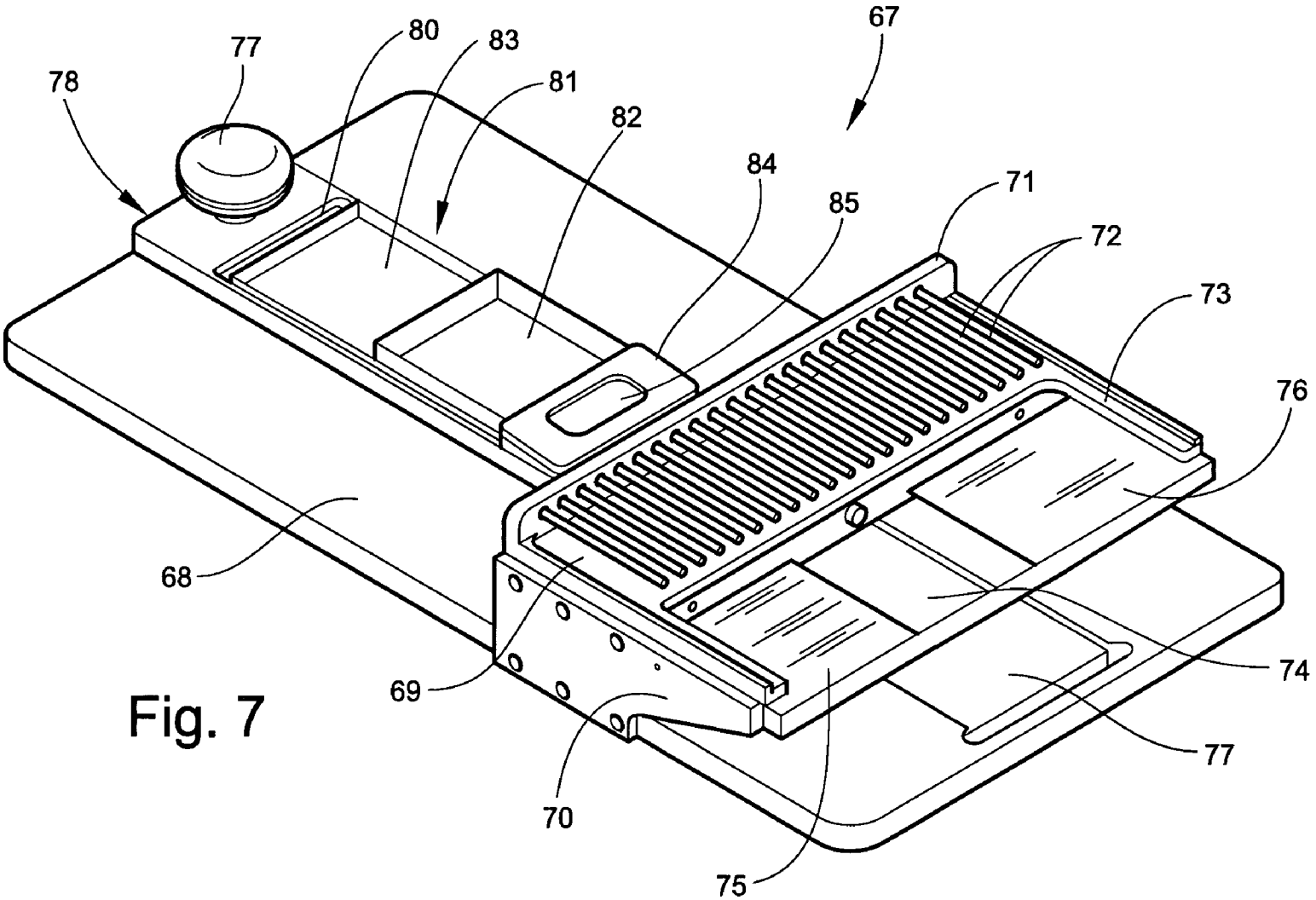
FIG. 7 is a perspective view of an apparatus for filling a cigarette package with manufactured cigarettes, in an embodiment of the present invention.

Referring to FIG. 7, there is shown a schematic illustration of a package-filling device 67 for filling a cigarette package with manufactured cigarettes 11. The package-filling device 67 includes a bottom frame, or base 68. A representative bottom frame 68 can be about 27.5 cm wide and about 56 cm long. A representative bottom frame 68 may be manufactured from any suitable material, but preferably is manufactured from aluminum.

The bottom frame 68 supports an upper platform 69. The upper platform 69 is suspended above the base 68 by left and right side walls 70. In a representative embodiment, the clearance between the upper face of the bottom frame 68 and the lower surface of the upper platform 69 is about 3 cm. A representative upper platform 69 may be manufactured from any suitable material, but preferably is manufactured from aluminum.

The upper platform 69 includes an upwardly extending ejection rod-supporting cross-member 71 that extends thereacross. Extending generally horizontally forward from the cross-member 71 is a plurality of ejection rods 72. In the embodiment shown, the package-filling device 67 includes 20 forwardly-extending ejection rods 72, each with a substantially circular cross-section. A representative ejection rod 72 has a length of about 7.2 cm and a diameter of about 4 mm and can be manufactured from steel. The package-filling device 67 preferably is adapted such that in a region forward of the ejection rods, there is a positioning platform region 73 for a cigarette tray 53 filled with 20 cigarettes 11. It is preferred that the cigarettes 11 within the cigarette tray 53 are positioned on their sides (that is, the longitudinal axis of each cigarette 11 is parallel to, or substantially parallel to, the horizontal plane, and aligned with the longitudinal axis of the package-filling device 67). The central portion of the positioning platform region 73 includes a broad space 74 open to the structures below, as is explained hereafter.

Below the front portion of the cigarette tray positioning platform region 73 are an inwardly sloping left panel 75 and an inwardly sloping right panel 76 that define the sides of an open center region 74. Representative sloping panels 75, 76 can be manufactured from sheets of highly polished stainless steel. A representative open center region 74 is generally rectangular with a width of about 8 cm and a length of about 9 cm.

The upper face of the bottom frame 68 includes a broad groove 77, channel, or other means for providing for controlled movement of a carriage 78 from the back of the base 68 to the front of the package-filling device 67. A representative groove 77 can have a vertical depth of about 4 mm to about 6 mm, a width of about 9 cm, and a length such that the groove 77 extends to within about 1 cm of the front end of the device 67. The arrangement of the carriage 78 and groove 77 preferably are such that the carriage 78 is easily movable within the groove 77. Typically, selection of the respective shapes and dimensions of the carriage 78 and the groove 77 define the arrangement of the carriage 78 in the groove 77. For example, the sides of the carriage 78 and the sides of the groove 77 may be designed so as to cooperate in a tongue-in-groove type of arrangement.

The carriage 78 includes an upwardly extending handle 79, such that the carriage 78 can be moved back and forth. Within a recess 80 in the upper face of the carriage 78 is positioned a cigarette package 81 in an open position. A representative package 81 can include a bottom component 82 for holding 20 cigarettes 11 (not shown), and a top cover 83 that is designed to close over the bottom component 82. A representative recess 80 can have a vertical depth of about 4 mm to about 6 mm; and a representative recess 80 having a length of about 19 cm and a width of about 9 cm can readily accommodate a package with a bottom component 82 having outer dimensions of about 8.2 cm wide, about 8.9 cm long and about 18 mm high (such dimensions being measured when the box is in a closed or sealed configuration).

In operation, the package-filling device 67 can be positioned firmly in place on a table, bench, counter, or the like. Alternatively, the package-filling device 67 can be permanently affixed to components of a work station. Optionally, a pre-cut inner package wrapping paper, foil/paper laminate or paper-lined foil (not shown) can be placed into the package 81. A typical foil sheet may have a width that approximates the width of the inner portion of the package, and a length of about 16 cm. A forming block (not shown) having stamp face dimensions approximating those of the inner bottom face area 82 of the package 81 can be used to push the foil into the box 81. In this manner, the foil can be creased within the bottom portion 82 of the box. The forming block then is removed from the box 81 so as to provide the box 81 having a type of inner liner positioned therein. In addition, the foil may be of such a length that tabs extend from both of bottom front and back of the package 81.

A backstop 84 located at the front of the carriage 78 assists in maintaining the package 81 in place during operation of the package-filling device 67. On the top face of the backstop 84 is positioned a slot 85. The slot 85 can be designed such that inner package wrapping paper or paper-lined foil extending from the front bottom 82 of the package 81 can be fed into the slot 85 in order that the foil is positioned out of the way when the cigarette package 81 is filled with cigarettes 11.

Figure 8:
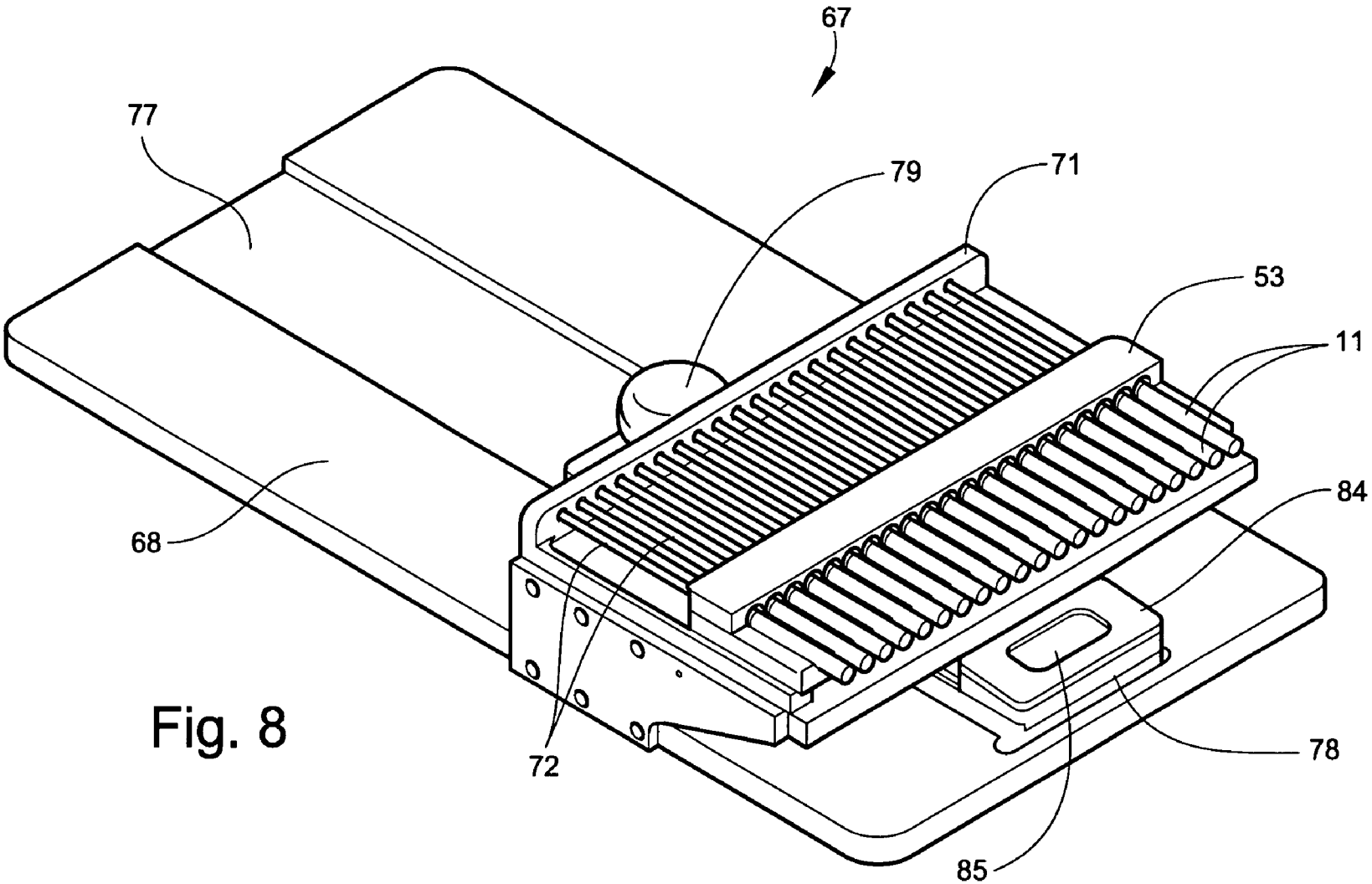
FIG. 8 is a perspective view of the apparatus shown in FIG. 7, showing the cigarette package beneath the open region of the positioning platform, in an embodiment of the present invention.

Referring to FIGS. 7 and 8, the package-filling device 67 is shown with the cigarette tray 53 containing 20 cigarettes 11 appropriately positioned on the positioning region 73 of the upper platform 69. The carriage 78 has been moved forward, such that the package 81 carried thereby is positioned below the open center region 74 beneath the cigarette tray 53. The device 67 is designed such that the tray 53 can be slid on the upper surface of the upper platform 69 towards the rear of the device 67. When the cigarette tray 53 is moved rearward, each ejection rod 72 remains still such that each rod 72 passes through the openings 60 in the front surface of the cigarette tray 53 (see FIG. 8) and resists rearward motion of the cigarettes 11 by pushing against the rear face of each filter element 62 of each respective cigarette 11. Effectively, as the cigarette tray 53 is moved rearward, each ejector rod 72 passes through the corresponding opening 60 in the front face of the cigarette tray 53, hence pushing the cigarettes 11 out of the tray 53. As such, cigarettes 11 can be removed from the cigarette tray 53 without the necessity of turning the tray 53 over to dump cigarettes 11 therefrom or of tipping the cigarette tray 53 upwards so that cigarettes 11 fall therefrom. The cigarettes 11 are pushed from the cigarette tray 53 and fall through the open center region 74 of the device 67. The cigarettes 11 consequently fall into, and fill, the open package 81 that is positioned below the open center region 74. An operator can use his/her finger to align the cigarettes 11 within the package 81, but preferably the cigarettes 11 are aligned without being touched, or are moved into alignment within the package 81 using a tool (for example, a nylon probe) that will not mar the cigarettes 11. The handle 79 then can be used to move the carriage 78 rearwards in order to expose the package 81 filled with cigarettes 11. The filled package 81 can be removed from the carriage 78 and closed. A new empty package 81 can then be inserted into the carriage 78. Meanwhile, the empty cigarette tray 53 can be moved forward and removed from the package-filling device 67. A new cigarette tray 53 filled with cigarettes 11 can be placed into the device 67. As such, the package filling process can be repeated.

In the representative device 67 for filling a cigarette package with manufactured cigarettes 11 described with reference to FIGS. 7 and 8, that device 67 is designed to fill the package 81 with 20 cigarettes 11. Suitable alterations to the device 67 and its components can be made to hold or transfer a greater or lesser number of cigarettes 11 contained in the cigarette tray 53. For example, a package 81 designed to contain ten cigarettes 11 can be filled with the embodiment described with reference to FIGS. 7 and 8 by loading ten cigarettes 11 into the cigarette tray 53 and using the device 67 to fill that package 81.

Figure 9:
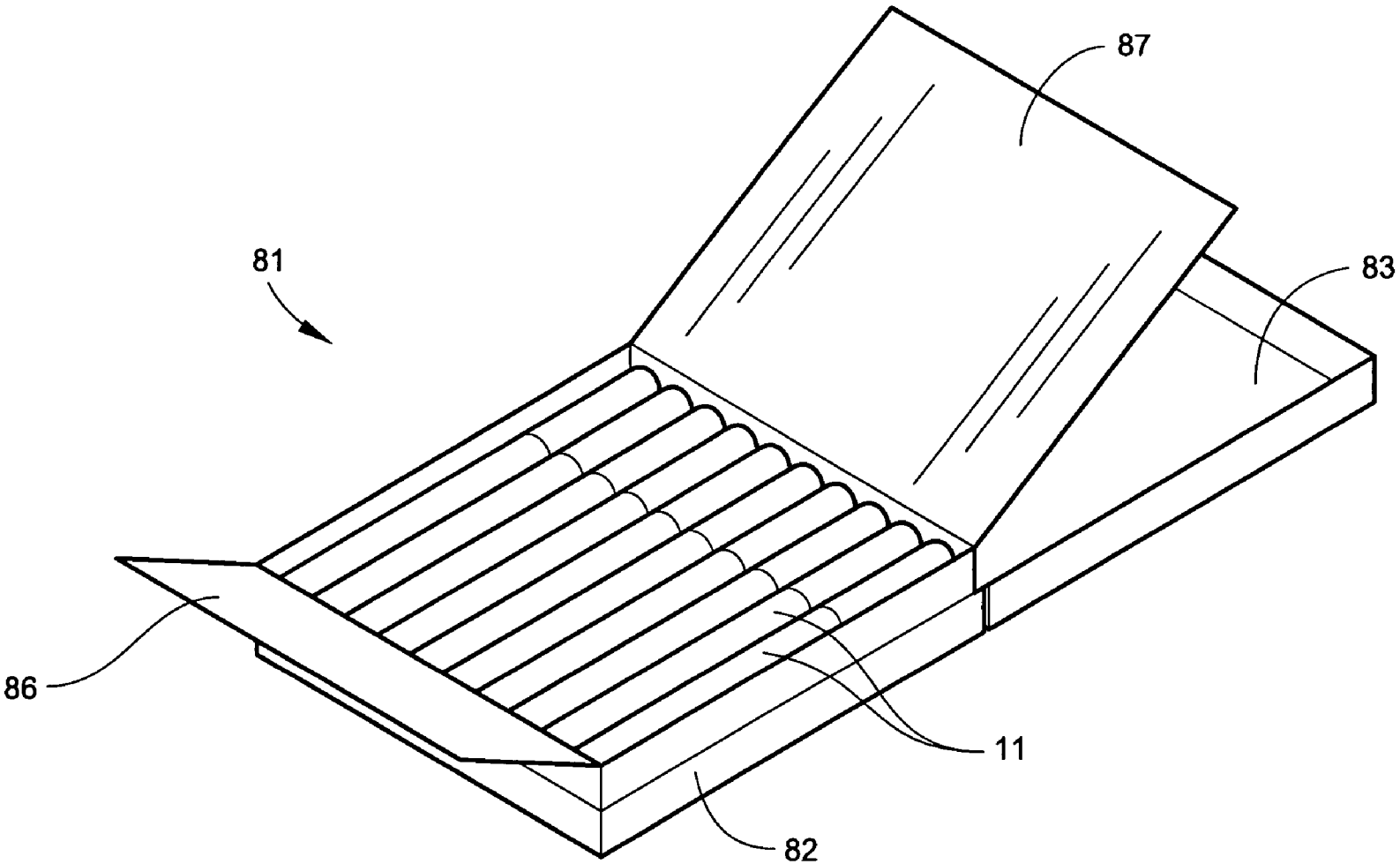
FIG. 9 is a perspective view of a package of cigarettes manufactured by embodiments of the present invention.

Referring to FIG. 9, there is shown a perspective view of a representative package 81 for cigarettes 11. The illustrated package embodiment 81 is of the type that has been referred to as a "shoulder box." The package 81 is shown in an open position and is designed to contain 20 cigarettes 11. As illustrated, the cigarettes 11 are aligned within the package 81 in two rows of ten cigarettes 11, with one row positioned over the second row. The packaged cigarettes 11 are preferably manufactured using the previously described equipment and materials. The package 81 preferably is manufactured from folded paperboard material, and can be of any type useful for the packaging of cigarettes 11.

The package 81 includes a generally rectilinear top cover 83 that opens about a hinge that extends along the back side of the box. The cigarettes 11 are contained in the bottom component 82 of the box. The bottom component 82 also holds a foil front flap 86 and a foil back flap 87 that can close over the cigarettes 11, or that can be opened to expose the cigarettes 11 (as is shown). Representative types of shoulder box packages 81 have been commercially available, and the selection thereof is a matter of choice. If desired, the shoulder box and associated wrapping materials can be embossed, printed with indicia, or the like. If desired, the package 81 of cigarettes 11 can be wrapped in a plastic or other film (for example, a clear polypropylene film).

Other representative types of cigarette packages suitable for use with the present invention includes those of the types set forth in U.S. Pat. Nos. 4,294,353 to Focke et al.; 4,534,463 to Bouchard; 4,852,734 to Allen et al.; and 5,139,140 to Burrows et al.; U.S. Pat. App. Pub. Nos. 2004/0217023 to Fagg et al. and 2004/0256253 to Henson et al.; and German Pat. App. DE 10238906 to Marx.

A small lot of cigarettes 11 can be manufactured in accordance with the present invention as described above during a relatively short time period. For example, for a lot of cigarettes 11 numbering approximately 20, an appropriate amount of tobacco filler 27 is selected, blended—if multiple tobacco types are selected—and loaded into the cigarette-making apparatus 10. A sufficient amount of the tobacco filler 27 for making a length of cigarette rod for cutting into 20 cigarettes 11 is delivered onto wrapping paper 12 in the garniture 18. The wrapping paper 12 is formed about the tobacco filler 27 to form a cigarette rod of predetermined length. The cigarette rod is then moved to the cutting device 19 and cut into 20 cigarettes 11. The cigarettes 11 can be moved to a tipping device where mouth piece ends can be added to the cigarettes 11. The cigarettes 11 can then be packaged for the consumer. All of the foregoing, can be carried out in less than about three minutes, and preferably can be carried out in less than about two minutes.

Tobacco materials useful within cigarettes 11 of the present invention may vary significantly. Tobacco materials can be derived from various types of tobacco, such as flue-cured tobacco, burley tobacco, Oriental tobacco or Maryland tobacco, dark tobacco, dark-fired tobacco and Rustica tobaccos, as well as other rare or specialty tobaccos, or blends thereof. Descriptions of various types of tobaccos, growing practices, harvesting practices and curing practices are set forth in *Tobacco Production, Chemistry and Technology*, Davis et al. (Eds.) (1999). Most preferably, the tobaccos used with the present invention are those that have been appropriately cured and aged.

Tobacco materials for cigarette manufacture can be used in a "single strain" form. That is, the tobacco material used to manufacture the cigarette 11 is composed of one type of tobacco (for example, all of the tobacco filler is a flue-cured tobacco). Typically, tobacco materials for cigarette manufacture are used in a so-called "blended" form. For example, certain popular tobacco blends, commonly referred to as "American blends," comprise mixtures of flue-cured tobacco, burley tobacco, and Oriental tobacco. Such blends, in many cases, contain tobacco materials that have a processed form, such as processed tobacco stems (for example, cut-rolled or cut-puffed stems), volume expanded tobacco (for example, puffed tobacco, such as dry ice expanded tobacco (DIET), preferably in cut filler form). Tobacco materials also can have the form of reconstituted tobaccos (for example, reconstituted tobaccos manufactured using paper-making type or cast sheet type processes). The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999). Other representative tobacco types and types of tobacco blends also are set forth in U.S. Pat. Nos. 4,836,224 to Lawson et al.; 4,924,888 to Perfetti et al.; 5,056,537 to Brown et al.; 5,220,930 to Gentry; and 5,360,023 to Blakley et al.; U.S. Pat. App. Pub. Nos. 2002/0000235 to Shafer et al.; 2004/0084056 to Lawson et al.; 2004/0255965 to Perfetti et al; 2004/0261807 to Dube et al.; and 2005/0066986 to Nestor et al; PCT Application Pub. No. WO 2002/37990; and Bombick et al., *Fund. Appl. Toxicol.*, 39, p. 11-17 (1997).

Tobacco materials employed for manufacture of cigarettes 11 in accordance with the present invention typically have forms, and are used in manners, that are traditional for the manufacture of smoking articles, such as cigarettes 11. The tobacco normally is used in cut filler form (for example, shreds or strands of tobacco filler cut into widths of about 1/20 inch to about 1/60 inch, often about 1/25 inch to about 1/50 inch, frequently about 1/30 inch to about 1/45 inch, and in lengths of about 1/4 inch to about 3 inches). One preferred form of cut filler 27 has a cut width of about 40 cuts per inch. Tobacco cut filler 27 is used in a loose form, that is, as a mixture of pieces of tobacco filler.

The amount of tobacco filler 27 normally used within the cigarette 11 of the present invention preferably ranges from about 0.6 g to about 1 g per individual cigarette 11. The tobacco filler 27 normally is employed so as to fill each cigarette 11 at a packing density of about 100 mg/cm$^3$ to about 300 mg/cm$^3$, and preferably about 150 mg/cm$^3$ to about 275 mg/cm$^3$.

If desired, the tobacco materials of the tobacco rod can also include other components. Other components may include casing materials (for example, sugars, glycerin, cocoa and licorice) and top dressing materials (for example, flavoring materials, such as menthol). The selection of particular casing and top dressing components is dependent upon factors such as the sensory characteristics that are desired, and the selection of those components will readily be apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

It is desirable that the moisture content of the tobacco filler 27 be sufficiently high so that the tobacco filler 27 does not undergo an undesirable degree of degradation during handling and processing associated with cigarette manufacture in accordance with the present invention. It also is desirable that the moisture content of the tobacco filler not be so high that the tobacco filler would exhibit undesirable clumping during handling and processing associated with cigarette manufacture in accordance with the present invention. Preferably, cigarettes 11 are manufactured using tobacco filler 27 having a moisture content of about 12 weight percent to about 13 weight percent. Tobacco filler 27 most preferably is purchased immediately prior to use, and stored and handled in a manner such that moisture is not lost. For example, in embodiments in which tobacco filler 27 is supplied to the garniture 18 in loose form, the tobacco filler 27 can be stored in sealed plastic bags, in sealed metal drums, or the like. Typically, for normal situations of tobacco filler handling, tobacco filler 27 can be shipped, handled, and stored in sealed containers or plastic bags in amounts of about 5 kilograms.

Tobacco filler 27 can be provided using techniques familiar in the art of tobacco blend formulation and preparation. Tobacco filler 27 can be provided using blending drums, air transport devices, or other suitable means that provides adequate physical mixing of pieces of tobacco filler material. It is highly desirable that the tobacco filler 27, whether as single strain or blended form, have the form of a consistent mixture in terms of distribution of particle size, density of components, and composition of components.

In an embodiment of the cigarette manufacturing apparatus 10, and components thereof, described with reference to FIGS. 1-4, that apparatus 10 may be designed to produce small lots, or batches, of cigarettes 11, for example, two or more cigarettes 11, having consistent density and quality of tobacco. For a particular selection of tobacco filler 27 (for example, as determined by factors such as composition, particle size, moisture content, and the like), and for pre-formed tobacco cartridges 13 of a particular size (for example, as determined by factors such as the length and circumference of the cartridge 13), a plurality of cigarettes 11 can be made to specification.

The embodiments of the cigarette manufacturing apparatus 10 shown in FIGS. 1-4 are designed to produce 20 cigarettes 11 substantially simultaneously, and the cigarette tray 53 is designed to hold 20 cigarettes 11. Suitable alterations to the apparatus 10 and its components can be made to produce any number of cigarettes 11 at a given time (for example, two, four, ten, twenty, or more cigarettes 11). Suitable alterations also can be made to provide the cigarette tray 53 capable of supporting any number of cigarettes 11 at a given time (for example, three, five, ten, thirty, forty, or more cigarettes 11). Exemplary embodiments of the cigarette manufacturing apparatus 10 can be designed and adapted to introduce tobacco filler 27 onto wrapping paper 12 of larger or smaller size and to make cigarette rods and cigarettes 11 of lesser or greater length.

Referring to FIG. 10, there is shown a representative cigarette 11 manufactured by an embodiment of the present invention. The cigarette 11 includes cigarette wrapping paper 12 that surrounds strands or pieces of tobacco cut filler 27, which is the smokable filler material that makes up the core of the cigarette 11. The lighting end 66 of the cigarette 11 preferably is configured such that the cut filler 27 does not extend beyond the end of the wrapping material 12 due to the method of cutting the cigarettes 11 from the finite length cigarette rod. Preferably, the cigarettes 11 are manufactured without damaging (for example, tearing) the wrapping material 12 at their lighting ends 66.

The dimensions of a representative cigarette 11 can vary. Cigarettes 11 may be substantially rod shaped, with, or example, diameters of about 7.5 mm (for example, circumferences of about 22.5 mm to about 25 mm), and total lengths of about 80 mm to about 100 mm. The filter element 62 includes filter material 63, for example, plasticized cellulose acetate tow, and is circumscribed by a plug wrap 64. The length of the filter element 62 can also vary. Typical filter elements 62 can have lengths of about 20 mm to about 40 mm, preferably about 25-35 mm, and most preferably about 25-30 mm. In one preferred embodiment, the length of the filter element 62 is about 27 mm and the length of the tobacco rod is about 56 mm. Preferably the tipping paper 65 circumscribes the entire filter element 62 and extends along about 4 mm of the length of the tobacco rod in the region adjacent to the filter element 62.

Cigarettes 11 manufactured in accordance with the present invention can be air diluted, or ventilated. The amount or degree of air dilution or ventilation can vary. Frequently, the amount of air dilution for an air diluted cigarette 11 can be greater than about 10 to 40 percent, and often does not exceed about 70 to 80 percent. Such cigarettes 11 can include pre-perforated tipping material 65 and a porous plug wrap 64 for introducing air dilution to the cigarette 11. A ring of air dilution perforations can extend around the cigarette 11 perpendicular to the longitudinal axis of that cigarette 11, and those perforations can be positioned at least about 10 to 15 mm from the extreme mouth end of the cigarette 11.

Embodiments of the present invention provide tobacco filler 27 wrapped inside a wrapping paper 12 in a controlled manner. As a result, a cigarette manufacturing apparatus 10 according to the present invention provides consistently-formed, uniformly-made cigarettes 11. Manufacturing a lot, for example, a lot of 20 cigarettes 11 in a retail setting, for example, in which each cigarette 11 has substantially the same density overcomes the disadvantage of producing cigarettes 11 individually, whereby individual cigarettes 11 may have non-uniformly packed tobacco rods of varying densities.

Preferably, cigarettes 11 are manufactured such that substantially all of the cigarettes 11 within a lot are of consistent quality. It is preferred that cigarettes 11 of a particular lot are comparable to one another in terms of appearance, size, shape, component materials, weight, tobacco filler particle size distribution, tobacco rod firmness, smoking properties, puff count, smoke yield, and the like. Preferred cigarettes 11 within a lot each incorporate tobacco filler 27 from a comparable source, and the weight of tobacco filler 27 within each cigarette 11 differs by not more that 10 percent, more preferably by not more than about 5 percent, and most preferably by not more than about 2.5 percent. In a preferred cigarette-making operation using each of the above-described devices, an operator never touches the wrapping paper 12 directly with his/her hands. This preferred mode of operation prevents moisture, skin oils, or other materials on the operator's hands from soiling or marring the aesthetic appearance of the wrapping paper 12.

Preferably, each cigarette 11 is uniformly filled with tobacco filler 27. That is, it is preferred that each cigarette 11 of the present invention (i) include a sufficient amount of tobacco filler 27, (ii) not contain tobacco fines that fall from the cigarette 11, (iii) not include what can be characterized as a "loose end," (iv) have good integrity throughout, and (v) not include low density or void regions.

A cigarette 11 made utilizing a cigarette manufacturing apparatus 10 according to the present invention preferably exhibits good firmness and good integrity. Specifically, when measured at 76° F. and 60 percent relative humidity using a Cigarette Firmness Tester Model No. CFTA supplied by Fairchild Industries, Winston-Salem, N.C., typical rods of 24.5 mm circumference and made by a conventional high-speed cigarette-making machine yield firmness values of about 2 to about 7 units. See, e.g., U.S. Pat. No. 4,962,773 to White et al. at col. 5, lines 10-24. Cigarettes 11 manufactured in accordance with the present invention preferably are less firm than comparable cigarettes (in terms of comparable component materials, sizes, formats and weights) that are manufactured using conventional automated cigarette manufacturing techniques, such as the type of cigarette-manufacturing machine available as "Protos" from Hauni-Werke Korber & Co. KG. In alternative embodiments, cigarettes 11 manufactured in accordance with the present invention may be firmer than comparable cigarettes 11 manufactured using a "Protos"-type of cigarette-manufacturing machine, depending on the way the cigarettes 11 are manufactured.

Preferred cigarettes 11 of the present invention exhibit desirable resistance to draw. For example, an exemplary cigarette 11 exhibits a pressure drop of between about 50 and about 200 mm water pressure drop at 17.5 cc/sec. air flow. Preferred cigarettes 11 exhibit pressure drop values of between about 70 mm and about 180, more preferably between about 80 mm to about 150 mm, water pressure drop at 17.5 cc/sec. air flow. Typically, pressure drop values of cigarettes 11 are measured using a "Filtrona Filter Test Station" (CTS Series) available from Filtrona Instruments and Automation Ltd.

Other embodiments of a cigarette manufacturing apparatus 10 according to the present invention may include alternative configurations of the tobacco filler delivery mechanism 16, tobacco supply, garniture 18, cigarette rod forming mechanism 31, cutting device 19, means for orienting cigarettes 21, and means for moving cigarettes 49 from the cutting device.

The present invention can include a method for manufacturing a small lot of cigarettes 11 utilizing the various embodiments of a cigarette manufacturing apparatus 10 described herein. In one illustrative method, at least one charge of tobacco filler 27 can be delivered from a supply of tobacco filler 27 onto a predetermined length of wrapping paper 12 in the garniture 18. The wrapping paper 12 can be formed about the charge of tobacco filler 27 by the forming mechanism 31 in the garniture 18. In an embodiment of such a method, the wrapping paper 12 can be sealed onto itself with an adhesive in the garniture 18 to thereby form a cigarette rod. The cigarette rod may be sealed while maintained in a stationary position in the garniture 18, or the wrapping paper 12 and tobacco filler 27 may be moved in the garniture 18 for sealing the paper 12 onto itself. The cigarette rod forming process can be initiated for forming a single, finite length cigarette rod and stopped when that rod is formed. The method thus provides for making a cigarette rod having a finite length (sufficient to make a predetermined number of cigarettes 11) formed in a discrete process separate from the process for cutting the cigarette rod into a plurality of cigarettes 11.

The cigarette rod formed in the garniture 18 can be to moved to the cutting device 19, and the cigarette rod can be cut into a plurality of individual cigarettes 11. In an embodiment, the steps of delivering a charge of tobacco filler 27 from the supply of tobacco filler 27 onto a wrapping paper 12 in the garniture 18, forming the wrapping paper 12 about the charge of tobacco filler 27, moving the cigarette rod formed therefrom to the cutting device 19, and cutting the cigarette rod into individual cigarettes 11 can be repeated to form a desired plurality of cigarettes 11.

In another aspect, the invention includes a method for manufacturing a small lot of cigarettes 11 in which a selection of tobacco 27 appropriate for use in cigarettes 11 is provided. A customer is allowed to select a tobacco 27 or blend of several tobaccos 27. The selected tobacco 27 or blend of tobaccos 27 is substantially simultaneously assembled into a plurality of cigarettes 11. At least some of the plurality of cigarettes 11 is then provided to the customer. The method may further include packaging the plurality of cigarettes 11.

In an alternative embodiment of the method, the step allowing a customer to select a tobacco 27 or blend of several tobaccos 27 includes allowing a customer to select a plurality of tobaccos 27 or a plurality of tobacco blends 27. Assembling the selected tobacco 27 or blend of tobaccos 27 into a plurality of cigarettes 11 can include assembling a plurality of cigarettes 11 wherein one or more of the plurality of cigarettes 11 includes a different tobacco 27 and/or blend than other(s) in the plurality of cigarettes 11. In another alternative embodiment of the method, the selected tobacco 27 or blend of tobaccos 27 is provided in the form of tobacco cartridges 13 that may be assembled into cigarettes 11 using, for example, a cigarette making apparatus 10 such as is described with reference to FIGS. 1-4.

A cigarette manufacturing apparatus 10 and method of the present invention may be incorporated within a tobacco specialty retail shop or store. That is, at least one such apparatus 10 may be on prominent display within the premises of in a retail establishment specializing in high quality or premium tobacco products. Such a shop or store may have a name that corresponds to the brand name of tobacco products available for sale within that shop or store. The shop or store preferably includes an inviting atmosphere, comfortable lounge areas or appropriate places to sit and enjoy the smoking of tobacco products, a high quality air handling or air conditioning system, and locations to purchase tobacco products. A customer within such a shop or store can talk with a tobacconist about the cigarettes 11 that are manufactured in that retail establishment. The packaging, filter materials 63, cigarette paper materials 12, tobacco components (including the selection of tobacco types and grade, tobacco blends, and casing and top dressing components) can be high quality in terms of sensory properties and appearance. Locating a cigarette making device within such a shop or store allows the customer within such an establishment to experience the manufacture of cigarettes 11, and enjoy cigarettes 11 that are freshly made in his/her presence. For example, that customer can smell the aroma of different tobaccos 27 within the store, and can view the manufacture of cigarettes 11 expressly for him/her. In this environment, using multi-sensory inputs (for example, sight and smell), the customer can make an informed decision on his/her selection of different tobaccos 27 and/or tobacco blends to be loaded into the cigarette making apparatus 10 to manufacture cigarettes in his/her presence. Thus, the devices and methods embodied in the present invention may be utilized in a retail setting that provides a customer with an aesthetic experience and an individually selected product.

An example of a cigarette manufacturing device having some components and operational characteristics similar to the cigarette manufacturing apparatus 10 according to the present invention is employed to manufacture cigarettes for commercial sale in the tobacco retail store located at the establishment operating as Marshall McGearty Tobacco Lounge at 1553 North Milwaukee Avenue, Chicago, Ill. That device can be employed to manufacture cigarettes 11 using the tobacco blends incorporated into those brand styles identified as The Standard, Karmelita, Oriental Rose, Malawi Kings, Cutlass, Samsun Straights, Virginia, Four Corners, The Empress, The Earl, North Star, Aegeans, and Muse within Marshall McGearty brand cigarettes by Marshall McGearty Tobacco Artisans.

A cigarette manufacturing apparatus 10 according to the present invention, and materials utilized in relation thereto, can be suitably modified and/or adapted to incorporate other types of cigarette rod forming components, or to operate using other types of mechanisms. For example, the apparatus 10 can be designed to incorporate suitably modified components, or to operate using the cigarette rod formation mechanisms, of the types set forth in U.S. Pat. Nos. 1,956,838 to Steurart; 2,242,000 to Kurst; 2,302,926 to White; 2,376,103 to Wahl; 2,404,242 to Moss; 2,415,910 to Roes; 2,427,957 to Getts; 2,436,015 to Morris; 2,437,615 to Rutherford; 2,868,209 to Marcotte; 3,011,498 to Armelin; and 4,832,056 to Bryant et al.; each of which is incorporated herein by reference.

Although the present invention has been described with reference to particular embodiments, it should be recognized that these embodiments are merely illustrative of the principles of the present invention. Those of ordinary skill in the art will appreciate that an apparatus and methods for manufacturing cigarettes of the present invention may be constructed and implemented in other ways and embodiments. Accordingly, the description herein should not be read as limiting the present invention, as other embodiments also fall within the scope of the present invention.

What is claimed is:

1. A cigarette manufacturing apparatus, comprising:

a supply of cigarette wrapping paper;

a supply of tobacco filler;

a garniture comprising a forming mechanism for forming a cigarette rod having a finite length for making a defined plurality of cigarettes;

a means for delivering an amount of the tobacco filler from the supply of tobacco filler onto a finite length of the wrapping paper in the garniture, the amount of the tobacco filler sufficient to form the cigarette rod;

a cutting device for cutting the cigarette rod into the plurality of cigarettes while the cigarette rod is stationary;

a means for transferring the cigarette rod from the garniture to the cutting device;

a means for orienting the plurality of cigarettes in the cutting device by turning each of the plurality of cigarettes approximately 90 degrees to place the cigarettes in side-by-side alignment, and comprising a cigarette support member for each cigarette to be cut from the cigarette rod, the cigarette support members interconnected with a pivot arm;

a means for moving the plurality of cigarettes from the cutting device to a tipping device; and a cigarette tray having a plurality of parallel surface grooves, the cigarette tray removable from the apparatus and adapted to be placed adjacent the cigarette support members in the cutting device such that each groove is aligned with one of the plurality of cigarettes for receiving that cigarette.

2. The apparatus of claim 1, wherein the means for moving the plurality of cigarettes comprises a set of cigarette ejector rods for ejecting the cigarettes from the cutting device onto the cigarette tray.

3. The apparatus of claim 1, wherein the cigarette tray is movable and securable relative to the cutting device for receiving multiple sets of the plurality of cigarettes.

4. The apparatus of claim 1, wherein the package-filling device is adapted for filling an open cigarette package directly from the cigarette tray.

5. The apparatus of claim 4, the cigarette tray further comprising a push through opening in alignment with each of the grooves, the package-filling device further comprising:

an upper platform suspended above a bottom frame at a distance to allow the cigarette package beneath the upper platform;

a plurality of substantially horizontal ejection rods mounted on the upper platform;

a cigarette tray positioning platform adjacent the ejection rods;

an inwardly sloping panel on each side of the positioning platform spaced apart to provide an opening sized to allow the cigarettes to drop substantially simultaneously through the opening; and a carriage mechanism for controlling movement of the open cigarette package beneath the opening in the positioning platform, wherein when the cigarette tray is moved on the positioning platform toward the ejection rods, the cigarettes in the cigarette tray are ejected onto the inwardly sloping panels, through the opening, and into the cigarette package.

* * * * *